US007177570B2

(12) United States Patent
Nagame et al.

(10) Patent No.: US 7,177,570 B2
(45) Date of Patent: Feb. 13, 2007

(54) MEASUREMENT OF FRICTIONAL RESISTANCE OF PHOTOCONDUCTOR AGAINST BELT IN IMAGE FORMING APPARATUS, PROCESS CARTRIDGE, AND IMAGE FORMING METHOD

(75) Inventors: Hiroshi Nagame, Shizuoka (JP); Hidetoshi Kami, Shizuoka (JP); Katsuichi Ohta, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 202 days.

(21) Appl. No.: 10/787,299

(22) Filed: Feb. 27, 2004

(65) Prior Publication Data

US 2004/0234294 A1 Nov. 25, 2004

(30) Foreign Application Priority Data

Feb. 28, 2003 (JP) ..... 2003-052281
Mar. 13, 2003 (JP) ..... 2003-067718

(51) Int. Cl.
*G03G 15/00* (2006.01)

(52) U.S. Cl. ..... 399/159

(58) Field of Classification Search ..... None
See application file for complete search history.

(56) References Cited

U.S. PATENT DOCUMENTS 5,204,034 A * 4/1993 Sasame et al. ..... 264/138
5,248,579 A * 9/1993 Terrell et al. ..... 430/58.25
5,512,976 A * 4/1996 Kamano ..... 399/116
5,976,743 A * 11/1999 Yamaki et al. ..... 430/58.2
6,014,532 A 1/2000 Takeichi et al.
6,030,733 A 2/2000 Kami et al.
6,060,205 A 5/2000 Takeichi et al.
6,118,964 A 9/2000 Kojima et al.
6,151,468 A 11/2000 Kami et al.
6,160,977 A 12/2000 Takeichi et al.
6,308,027 B1 10/2001 Obu et al.
6,326,112 B1 12/2001 Tamura et al.
6,363,237 B1 * 3/2002 Nagame et al. ..... 399/343
6,521,386 B1 2/2003 Sakon et al.
6,542,707 B2 4/2003 Muramatsu et al.

(Continued)

FOREIGN PATENT DOCUMENTS

JP 05265243 A * 10/1993

(Continued)

OTHER PUBLICATIONS

U.S. Appl. No. 11/007,784, filed Dec. 9, 2004, Kondo et al.

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a photoconductor having a surface with a frictional resistance ranging from 45 gram-force to 200 gram-force, a 10-point average roughness RzJIS ranging from 0.1 mm to 1.5 mm or a maximum height Rz of 2.5 mm. Image formation is performed by the image forming apparatus to allow irregular-shaped toner or spherical toner to be cleaned off efficiently and any background stain on a copied sheet to be prevented. A lubricant is applied to the photoconductor so as to form a nonuniform film thereon, which prevents the frictional resistance from abnormally lowering, thus suppressing image degradation.

40 Claims, 9 Drawing Sheets

U.S. PATENT DOCUMENTS

| | | | |
|---|---|---|---|
| 6,558,862 | B2 | 5/2003 | Kojima et al. |
| 6,562,529 | B1 | 5/2003 | Kojima et al. |
| 6,573,016 | B2 | 6/2003 | Kami et al. |
| 6,597,883 | B2 | 7/2003 | Muramatsu et al. |
| 6,641,964 | B2 | 11/2003 | Ikuno et al. |
| 6,653,033 | B1 | 11/2003 | Kami et al. |
| 6,674,982 | B2 | 1/2004 | Saitoh et al. |
| 6,686,114 | B2 | 2/2004 | Sakon et al. |
| 6,697,584 | B2 | 2/2004 | Tsunoda et al. |
| 6,706,459 | B2 | 3/2004 | Kojima et al. |
| 6,707,480 | B2 | 3/2004 | Ameyama et al. |
| 6,725,003 | B2 | 4/2004 | Shinkai et al. |

FOREIGN PATENT DOCUMENTS

| | | | |
|---|---|---|---|
| JP | 06138685 | A * | 5/1994 |
| JP | 8-44245 | | 2/1996 |
| JP | 11-249328 | | 9/1999 |
| JP | 2000-75752 | | 3/2000 |
| JP | 2000-162802 | | 6/2000 |
| JP | 2001-5359 | | 1/2001 |
| JP | 2001-66963 | | 3/2001 |
| JP | 2001-142371 | | 5/2001 |
| JP | 2001-265039 | | 9/2001 |
| JP | 2001-312191 | | 11/2001 |
| JP | 2002-149031 | | 5/2002 |
| JP | 2002-258666 | | 9/2002 |

OTHER PUBLICATIONS

U.S. Appl. No. 11/030,307, filed Jan. 7, 2005, Kami et al.
U.S. Appl. No. 11/016,708, filed Dec. 21, 2004, Kitajima et al.
U.S. Appl. No. 08/862,260, filed May 23, 1997.
U.S. Appl. No. 09/985,347, filed Nov. 2, 2001, Tamoto et al.
U.S. Appl. No. 10/101,994, filed Mar. 21, 2002, Ueda.
U.S. Appl. No. 10/103,791, filed Mar. 25, 2002, Suzuki et al.
U.S. Appl. No. 10/135,548, filed May 1, 2002, Kami et al.
U.S. Appl. No. 10/235,961, filed Sep. 6, 2002, Ikegami et al.
U.S. Appl. No. 10/231,281, filed Aug. 30, 2002, Kosuge.
U.S. Appl. No. 10/293,334, filed Nov. 14, 2002, Saito et al.
U.S. Appl. No. 10/352,075, filed Jan. 28, 2003, Kojima et al.
U.S. Appl. No. 10/384,701, filed Mar. 11, 2003, Nohsho et al.
U.S. Appl. No. 10/417,169, filed Apr. 17, 2003, Fukuchi.

* cited by examiner

PHOTOGRAPH 1

PHOTOGRAPH 2

MEASUREMENT OF FRICTIONAL RESISTANCE OF PHOTOCONDUCTOR AGAINST BELT IN IMAGE FORMING APPARATUS, PROCESS CARTRIDGE, AND IMAGE FORMING METHOD

CROSS-REFERENCE TO RELATED APPLICATIONS

The present document incorporates by reference the entire contents of Japanese priority documents, 2003-052281 filed in Japan on Feb. 28, 2003 and 2003-067718 filed in Japan on Mar. 13, 2003.

BACKGROUND OF THE INVENTION

1) Field of the Invention

The present invention relates to an image forming apparatus that employs an electrophotographic process to form an image, and to a process cartridge detachably mounted in the image forming apparatus and an image forming method.

2) Description of the Related Art

Digital type image forming apparatuses that employ an electrophotographic process to form images are widely used. Facsimiles, printers, and copying machines are examples of the image forming apparatuses. The image forming apparatus generally includes a photoconductor, a charger, an image exposing device, a developing device, a transfer device, a separator, a cleaning device, a decharger, and a fixing device.

A photoconductive material used for the photoconductor includes zinc oxide, cadmium sulfide, cadmium selenide, an amorphous selenium type material such as a-Se and a-$As_2Se_3$, an amorphous silicon type material such as a-Si:H and a-Si:Ge:H, and polyvinyl carbazole. However, these photoconductive materials are hazardous and costly. Therefore, the now a days organic photoconductors (OPC) are used as the photoconductive material because it has many advantages from the viewpoint of energy saving, resources saving, manufacturing easiness, possibility of highly sensitive design, low costs, and non-contamination.

When the organic photoconductor is used, the typical layer structure includes a single layer structure or a dual layer structure (hereinafter, "function separated type photoconductor"). The single layer structure includes a layer of material that is a mixture of a material for generating an electric charge and a material for transporting the generated charge. The function separated type photoconductor includes two distinctly separate layers of the material for generating the electric charge and the material for transporting the generated charge. Of these two types of the photoconductors, the function separated type photoconductor is more easily available in the market.

Because analog type of image forming apparatuses are now being replaced with digital type of image forming apparatuses, photoconductors that can be suitably used in the digital type of image forming apparatuses are being developed.

A typical photoconductor for the digital type of image forming apparatuses (hereinafter, "digital type photoconductor") includes a base coating layer of thickness ranging from 1 micrometer (μm) to 20 μm, a charge generation layer of thickness ranging from 0.1 μm to 5 μm, and a charge transport layer of thickness ranging from 10 μm to 50 μm in this order on a conductive support made of aluminum or the like.

The charge transport layer formed on the uppermost layer of the photoconductor has an advantage in that the degree of design flexibility to mechanical durability is widened. Polycarbonate resin (A type, C type, Z type, or the like) is generally used for a binder resin of the charge transport layer. When this resin is used for a photoconductor, the number of durable sheets is about 50,000 sheets to 80,000 sheets as the A4-size paper.

The durability of the photoconductor can be increased by various methods. One approach is to use a polymer for the charge transport layer and form a abrasion-resistant protective layer such as an amorphous carbon film or an amorphous silicon film on the charge transport layer by from about 0.5 μm to about 5 μm using a plasma chemical-vapor deposition (CVD) method or a vacuum evaporation method. Other approach is to form a resin layer or a photoconductive layer on the charge transport layer by from about 1 μm to about 10 μm. More specifically, the resin or photoconductive layer is obtained by adding high hardness particles (filler) such as α alumina, titanium oxide, or tin oxide by from 1 percent to 60 percent by weight (wt %) using a dip coating method and a splaying method.

A charging method used to form images using the organic photoconductor includes a corona discharging method that charges the photoconductor with an electrode that is separated from the photoconductor by from about 5 millimeters (mm) to about 10 mm. The charging method also includes a contact charging method of bringing a charging member into contact with the photoconductor. The charging method further includes a non-contact charging method (or proximity charging method) of charging the photoconductor with a charging member that is separated from the photoconductor by from about 30 μm to about 100 μm. A corona charger and a contact charger are generally applied with a direct current (dc) voltage. However, in a case of a non-contact charger or a charger requiring charging stability in particular, a charging member thereof is applied with a voltage by superposing an alternating current (ac) voltage with a voltage of from about 800 to about 2000 volts and frequency of from 600 to 2500 hertz on a dc voltage (450 volts to 850 volts). The function separated type photoconductor is generally negatively charged and a surface voltage thereof is from about −400 volts to about −1200 volts.

A method of visualizing an electrostatic latent image formed on the photoconductor by exposing the image after charging includes a spray-type developing method and a cascade developing method. However, these methods are lack of convenience, and in these days, therefore, a magnetic brush developing method having such advantages as follows is generally used. The advantages are such that downsizing of the image forming apparatus is easy, developing traceability of an electrostatic latent image and high resolution are easily obtained, and a comparatively sufficient signal-to-noise (SN) ratio for background stain is obtained.

Toner used in the magnetic brush developing method often includes pulverized toner whose average sphericity produced by a pulverization method is from about 0.90 to about 0.95 and an average particle size is from about 4 μm to about 10 μm. The pulverized toner has an irregular shape with many irregularities, which allows comparatively better cleaning capability even if a cleaning blade is used.

However, the particle size of the toner used in the magnetic brush developing method is widely distributed (e.g., ±5 μm) and the toner includes many pulverized toner particles. Therefore, charges are difficult to be held identically, and development capability with fidelity to an electrostatic latent image is low, which makes it difficult to obtain sharp edges.

Because of this, high resolution is limited. Further, since the charge of the toner is nonuniform, the toner is not fully transferred to a transferred element, which causes much toner to remain on the photoconductor after transfer process, and also causes cleaning failure when micro toner particles of from about 0.5 μm to about 2 μm are included.

The average sphericity is by using FPIA-1000 base on an equation:

average sphericity=Σ(circumference of a circle having the same area as a projected area of a particle image÷circumference of a particle projected image")÷the number of particles measured.

It is noted that the number of measured particles is 1,000 or more, particles with a particle size of 5 μm or more are selected, and a toner image is projected to calculate a circumferential length thereof.

The pulverization method is executed by putting additives such as a colorant and a charge control agent into binder polymer produced in a polymerization method, mixing them using a dry type blender, a Henschell mixer, or a ball mill, melting them to obtain a lump, roughly pulverizing and finely pulverizing the lump, and classifying pulverized particles by a sieve or the like for each particle size to produce toner particles.

By mixing 3 wt % to 8 wt % of toner with magnetic powder called carrier such as ion, ferrite, or nickel whose average particle size is from about 40 μm to about 80 μm to cause frictional charging, and the mixture of the toner and carrier is used as developer.

A popular unit of cleaning off powder is a fur blush type unit. More specifically, the powder includes toner and paper dust remaining on the photoconductor after image toner is transferred to a transferred element (paper for Over Head Projector or copy paper). As the fur blush, rabbit fur, pig fur, polyester fabric, or nylon fabric is used conventionally, but currently, a blade cleaning method becomes dominant. The blade cleaning method has advantages in some aspects such as compact size, handling, and manufacturing cost.

A material of the blade used in the blade cleaning method includes an elastic material such as neoprene rubber, chloroprene rubber, silicon rubber, or an acrylic rubber. However, polyurethane rubber (or urethane rubber) is generally used because it does not cause any chemical damage to the photoconductor and has characteristics excellent in durability, ozone resistance, and oil resistance.

The cleaning member of the blade cleaning method using in the cleaning device includes a rubber blade and a support base, and most of cleaning blades are slip-shaped (plate-shaped) cleaning blades each of which thickness is from 1.5 mm to 5 mm.

The cleaning member is used by fixing the slip-cut polyurethane rubber to a metal support such as an iron plate or an aluminum plate using a hot melt adhesive or a double-faced tape so that a free length from the end of the metal support to the edge of the blade is from 2 mm to 10 mm.

The cleaning member is disposed in either manner in which the edge of the blade is directed to the photoconductor in a trailing direction and in a counter direction. Currently, however, the counter method is generally employed because it is excellent in cleaning capability and cleaning maintainability.

The cleaning member is fixed so that the blade edge is in linear contact with the photoconductor and a constant load (contact pressure) of from about 10 g/cm to about 40 g/cm is applied to the cleaning member using a spring or the like. The linear contact is employed in order to avoid excessive frictional resistance between the photoconductor and the cleaning blade, and to make most effective use of the scraping effect by the edge to perform excellent cleaning. Actually, even if the blade edge is in linear contact with the photoconductor, the linear contact is made to be flat and therefore the contact has a width of from about 0.5 mm to about 1 mm. If a contact area becomes wider, toner and paper dust are forcefully pressed against the photoconductor, which is undesirable. For the cleaning performance, therefore, it is desirable to keep the linear contact as much as possible.

The load is applied because the blade edge is brought into tight contact with the photoconductor and a space between them is prevented during rotation of the photoconductor. Therefore, influence of foreign matters existing on or adhered to the photoconductor, irregularities, micro scratches, and of flaws produced when the blade slides along the photoconductor is avoided to keep cleaning capability of the residual powder at a predetermined level.

The cleaning blade is in contact with the photoconductor in the counter direction to cause the blade edge to be engaged in the photoconductor. Accordingly, the tight contact between the photoconductor and the blade edge is enhanced, thus improving the cleaning capability much higher as compared with that of the trailing method. However, if the load is applied too heavily, the blade edge is made to be flat, and the contact is made to be face contact. The face contact increases the frictional resistance with the photoconductor, which causes the blade edge to be pulled in the direction of rotation of the photoconductor and to be returned, that is, a stick-slip phenomenon tends to occur. Thus, both the photoconductor and the cleaning blade are easily and greatly damaged.

Recently, images with high quality such as high-definition and high-resolution color images or monochrome images have been required. With this, polymer toner is increasingly used in printers and electrophotographic copying machines. The polymer toner has an almost spherical shape, and further, the size distribution of particles ranges about ±0.5 μm by using a well-controlled manufacturing method for the polymer toner. Therefore, the polymer toner can be uniformly charged and is excellent in developing capability with fidelity to an electrostatic latent image, transfer capability, and color reproduction when images are superposed on each other.

However, when the pulverized toner is used, even if the cleaning method in which the cleaning capability is excellent because of the contact in the counter direction is used, there comes up such a problem that cleaning is failed at the first sheet if almost spherical toner with high average sphericity is used.

Even if the cleaning is perfectly done at the beginning, cleaning failure may suddenly occur in the middle of copying operation. Furthermore, a large number of sheets may be copied without realizing the number in an imaging device because it performs bulk copy of data at a high circumferential speed.

Substantially spherical toner particles rush to the blade as if they roll over the photoconductor, and therefore, the toner particles slide into even small spaces to easily cause cleaning failure.

During charging to the photoconductor, a large amount of corona product materials (ozone, NOx, or SOx) is produced from the charger to be adhered to the photoconductor. During development, toner is adhered to the photoconductor, and paper dust is adhered thereto during transfer. If a contaminant including the corona product materials, toner, and paper dust adhered to the photoconductor is pressed against the photoconductor by a contact member such as the cleaning blade and the charging member, a film of the contaminant (e.g., toner filming) is formed on the surface of the photoconductor, which causes frictional resistance to increase.

Generally, the polyurethane rubber is used for the cleaning blade so that the blade edge comes in linear contact with the photoconductor. However, if the frictional resistance increases, frictional heat is produced between the cleaning blade and the photoconductor, which causes the film on the surface of the photoconductor to be melted or toner deposited on the blade to be fused. Slidability is thereby degraded, and mechanical pressure balance between the edge of the cleaning blade and the photoconductor is lost. Furthermore, the cleaning blade cannot come in uniform contact with the photoconductor, micro-vibrations are produced with rotation of the photoconductor, and a space between the cleaning blade and the photoconductor is easily produced.

Then, the stick-slip phenomenon occurs, and when the blade edge is pulled at maximum, a further larger space is produced. The stick-slip phenomenon becomes worse with an increase in the frictional resistance of the photoconductor.

Since the frictional force of the blade edge against the photoconductor increases, the photoconductor is easily flawed. Further, visible scratches occur at a portion against which the blade edge is partially and heavily pushed, that is, the surface roughness is caused to increase.

The blade edge is susceptible to damage when the cleaning blade slides along a photoconductor especially including an outermost surface layer that contains a filler of particles with high hardness such as alumina or tin oxide. Specifically, the particles each with a primary particle size of from about 0.1 μm to about 0.7 μm are often used. The agglomeration of the scraped filler is pressed against the photoconductor by the cleaning blade to cause the photoconductor to be deeply scratched and the blade edge to be chipped. This tendency is getting worse with larger particle size of the contained filler.

Furthermore, the photoconductor is hard to be worn, and therefore, the film is easily formed thereon, thus the photoconductor is scraped non-uniformly. Therefore, the frictional resistance of the photoconductor largely increases to cause the blade edge to be deformed or the stick-slip phenomenon to easily occur.

If the deep scratch has been produced, the blade edge is partially twisted or partially applied with pressure, which causes the blade edge to chip.

If the scratch on the photoconductor and the chip of the blade edge become larger, cleaning failure of toner more easily occur.

If the frictional resistance of the photoconductor increases, strong pressure is applied to the blade edge, which causes the blade edge to be partially distorted, resulting in being chipped. A largely chipped part sometimes extends from 120 μm to 200 μm.

If the chip is large, the space between the photoconductor and the cleaning blade is quite impossible to be shielded even if a higher contact pressure is applied. Cleaning failure thereby occurs, and spot-shaped cleaning failure occurs in the initial stage at a portion where the blade largely chips, and the spot-shaped cleaning failure becomes band-shaped. Furthermore, cleaning failure is thinly and widely spread over a portion of the photoconductor where surface roughness is high.

Patent documents that describe frictional resistance between the photoconductor and the cleaning blade are as follows.

Japanese Patent Application Laid Open (JP-A) No. 2000-162802 discloses that an increase in frictional resistance on the surface of a light receiving member speeds up degradation of a cleaning blade and reduces cleaning capability of residual toner to cause cleaning failure to occur.

JP-A No. 2001-1421371 discloses that a cleaning blade is excellent in elasticity, but because of high frictional resistance on the surface of a photoconductor, the edge of the cleaning blade is folded in the direction of rotation of a photoconductive drum, so-called "curling" occurs. This occurs depending on a correlation between pressure force against the photoconductive drum and frictional force with the photoconductive drum, which does not allow normal cleaning.

JP-A No. 2001-265039 discloses that an organic photoconductor has high frictional resistance with respect to a cleaning blade used to remove residual toner, and therefore, the organic photoconductor is worn or the surface of the photoconductor is damaged when the cleaning blade cleans the surface thereof.

JP-A No. 2001-066963 discloses that frictional resistance between a photoconductor and a cleaning blade increases during cleaning to cause the blade to be easily reversed.

JP-A No. 2002-258666 discloses that a frictional coefficient of a photoconductor increases and frictional resistance between cleaning members increases, which causes micro-vibrations or twist of the cleaning member to easily occur on the surface of the cleaning member and cleaning failure of toner to easily occur. As a result, abrasion of a photoconductive layer is speeded up to shorten the life of the photoconductor.

Means of improving cleaning failure of highly spherical polymer toner using the blade cleaning method include the following conventional technologies.

For example, JP-A No. 2001-312191 (Scope of claims, Paragraph Nos. [0012] to [0014], [0067] to [0074], and [0118]) discloses that toner having a shape factor SF-1 of 100 to 140 and toner having a shape factor SF-2 of 100 to 120 are used, a linear pressure of a cleaning blade is set to 20 g/cm or more and less than 60 g/cm. Chips scraped (agglomeration of fluororesin or the like) from the surface of a photoconductor (containing 10 wt % to 50 wt % of fluororesin) are collected to the blade to allow sufficient cleaning to be performed on even highly spherical toner. This is because, by setting a contact pressure of the cleaning blade to slightly higher, it is prevented to form a space between the photoconductor and the blade. By causing the blade to contain a further amount of fluororesin, a frictional coefficient is decreased and the fluororesin is made easier to be scraped. Further, the scraped fluororesin is agglomerated at a place for cleaning by the blade to form a blockage by the agglomerated fluororesin so that the toner is prevented from sliding into the space and cleaning failure is also prevented.

JP-A No. 2001-312191 also discloses in its first example that 30 wt % of fluororesin is added to a surface layer of the photoconductor and the contact pressure (linear pressure) is set to 33 g/cm to perform image formation. However, the frictional coefficient of the photoconductor is kept at a low level because of a large amount of addition of fluororesin, but the quality of a film is friable. Therefore, if the contact pressure is set to 33 g/cm that is higher than ordinary contact pressure, a fluororesin layer is easily worn. As a result, it is found that the durability of the photoconductor is decreased to about one half the durability of a photoconductor without the fluororesin layer. The large amount of addition of fluororesin causes surface roughness (10-point average roughness RzJIS) to be higher than its initial stage by from 2 μm to 3 μm. Accordingly, the surface roughness is increased using the photoconductor for image formation.

With the increase in the surface roughness, corona product materials produced by charging slide into "valleys" of the surface of the photoconductor. Consequently, some part of the blade edge is easily distorted, and at about the same time, the stick-slip phenomenon tends to easily yet gradually occur. The scraped fluororesin is agglomerated at the edge of the cleaning blade, but spherical toner is easy to pass through a fluororesin agglomeration. Therefore, there is some discouraging factor against cleaning failure that may occur with deformation of the blade edge.

JP-A No. 2000-075752 (Scope of claims, Paragraph Nos. [0009] and [0026]) discloses that toner whose shape factor SF-1 is 100 to 140, a cleaning blade whose hardness is from 60 to 80 degrees, and a linear pressure is set to from 55 g/cm to 105 g/cm to perform image formation while applying a lubricant.

In JP-A No. 2000-075752, if spherical toner is used, it is more effective to increase the linear pressure of the cleaning blade as compared with the case where pulverized toner having low sphericity (shape factor is low) is used. However, since the linear pressure in this case is twice to four times higher than the ordinary case, which is abnormally high, a workload to the photoconductor and the cleaning blade become extremely heavy. Therefore, the photoconductor and the edge of the cleaning blade are damaged, and cleaning failure inevitably occurs early because of distortion of the blade edge and the stick-slip phenomenon.

JP-A No. 2002-149031 (Scope of claims, Paragraph Nos. [0025] to [0030]) discloses that cleaning failure is prevented even for substantially spherical toner by making the surface of an image carrier (photoconductor) contain 10 wt % to 50 wt % of fluororesin, and by setting surface roughness Rz of the photoconductor to Rz<5.0 μm, a dynamic frictional coefficient p between the photoconductor and a cleaning blade to $0.5 \leqq \mu \leqq 2.5$, and a linear pressure A to $200\times10^{-3}$N/cm<A<$600\times10^{-3}$N/cm.

In JP-A No. 2002-149031 as is disclosed in JP-A No. 2001-312191, by making the photoconductor contain a large amount of fluororesin, the dynamic frictional coefficient is lowered and a contact pressure of the cleaning blade is set to high to improve the cleaning capability of the spherical toner. It is assumed that Rz<5.0 μm is set because the photoconductor is made to contain a large amount of fluororesin, which causes the surface roughness of the photoconductor to become inevitably high.

Surely, by adding a large amount of fluororesin (e.g., Teflon: trademark) to the photoconductor, the dynamic frictional coefficient can be lowered. Consequently, the blade edge is less distorted, and probability of occurrence of cleaning failure is decreased. However, the photoconductive layer is worn abnormally, durability of the photoconductor is largely decreased, and the surface roughness of the photoconductor is made higher and higher. Therefore, the cleaning failure of toner tends to occur early. If the contact pressure (or linear pressure) of the blade is increased in order to recover the cleaning failure, the photoconductor and the blade edge are getting worse and worse to reach a level where the cleaning failure is impossible to be recovered.

Particularly, if the surface layer of the photoconductor has the content of fluororesin with which the dynamic frictional coefficient is kept at such a high level as 2.5, the distortion of the blade edge and the stick-slip phenomenon surely easily occur, and deposition of the corona product materials on the photoconductor causes the dynamic frictional coefficient to be increased, and therefore, cleaning failure may occur permanently.

JP-A No. Hei 11-249328 (Scope of claims, Paragraph No. [0006], FIG. 1) discloses that a layer of a light receiving member is formed with silicon atoms as a base in which frictional resistance of the surface of the photoconductor ranges from 0.1 gram-force (gf) to 150 gf, which allows blade chattering due to friction to less occur and degradation of the blade to be suppressed. It is thereby possible to obtain excellent cleaning capability and increase the variety of toner to be used.

Frictional resistance is measured by a dynamic distortion measuring device produced by HEIDON under the conditions as follows. An elastic rubber blade having a width of 5 centimeters and Japanese Industrial Standards (JIS) hardness ranging from 70 degrees to 80 degrees is pressed at a pressure of 20 g/cm against the photoconductor through a developer mainly containing styrene whose average particle size is 6.5 μm. Under such situations, the light receiving member is made to move at a speed of 400 mm/sec.

In JP-A No. Hei 11-249328, a material used for a photoconductive layer allows satisfactory cleaning. The material contains non-single crystal containing silicon atoms as a base with hydrogen atoms and carbon atoms, or non-single crystal hydrogenated carbon film. Such a photoconductor has high hardness, unlike the organic photoconductor, is extremely dense, and has a surface roughness of 0.1 or lower which is highly smooth. Accordingly, the photoconductive layer is worn extremely less, is never affected by the surface roughness for a long term, and has such durability that image formation of a million sheets or more as the A4-size paper can be achieved. Therefore, there hardly occurs cleaning failure due to surface roughness of the photoconductor or cleaning failure due to largely chipped blade edge. Furthermore, the frictional resistance in the initial stage is low.

Although the photoconductor has the non-single crystal or the non-single crystal hydrogenated carbon film formed on the outermost layer thereof, the photoconductor has a high hardness, and the corona product materials such as ozone and NOx produced during charging are easily deposited thereon, but the photoconductor is hard to be worn. Therefore, the corona product materials are not worn to gradually accumulate thereon, which causes frictional resistance to be gradually increased. As a result, the blade edge is easily distorted and cleaning failure easily occurs caused by microvibrations of the blade edge or the stick-slip phenomenon.

The photoconductor described in JP-A No. Hei 11-249328 does not obtain effects by externally adding powdery lubricant such as fluororesin even if the corona product materials are adhered to the photoconductor to cause the physical property of the surface to change. This is because the photoconductive layer is hard and the powdery lubricant is not rubbed into it, unlike the organic photoconductor. In other words, it is difficult to lower the frictional resistance on the surface of the photoconductor, and it is also quite hard to improve the cleaning failure by lowering the frictional resistance with the lubricant.

Although a numerical range of the frictional resistance on the surface of the photoconductor is described in JP-A No. Hei 11-249328, the frictional resistance is largely different depending on measuring units.

Frictional resistance is measured by a dynamic distortion measuring device produced by HEIDON under the conditions as follows. An elastic rubber blade having a width of 5 centimeters and Japanese Industrial Standards (JIS) hardness ranging from 70 degrees to 80 degrees is pressed at a pressure of 20 g/cm against the photoconductor through a developer mainly containing styrene whose average particle size is 6.5 μm. Under such situations, the light receiving member is made to move at a speed of 400 mm/sec.

By setting the frictional resistance to an appropriate range, It is possible to improve the cleaning capability. However, an a-Si photoconductor is different in the physical property on its surface from that of the organic photoconductor. Therefore, the described numeral range is not applied to the organic photoconductor as it is. Furthermore, the measuring method is different from the method described in the present invention.

The a-Si photoconductor is affected by ozone and low-resistance $SiO_2$ is thereby easily formed. Therefore, the frictional resistance on the surface layer of the photoconductor tends to be increased step by step, which may result in going out of the specified range of frictional resistance during using it.

JP-A No. 2001-005359 (Paragraph No. [0040]) teaches to clean the toner using a cleaning blade while applying a solid lubricant to a photoconductor through a brush roller in contact with the photoconductor.

According to the example in JP-A No. 2001-005359, however, as a result of image formation by using toner whose average particle size was 7.5 μm, cleaning failure occurred after image formation of about 23,000 sheets. When the blade edge was checked after image formation of 25,000 sheets was finished, it was observed that the edge of the cleaning blade had a broken (chipped) part with a depth of from 10 μm to 30 μm and a width of from 10 μm to 120 μm. However, only the results were described, and no mention was made of the relation between the depth or the width of the blade and the cleaning failure.

In other words, it is described in JP-A No. 2001-005359 that the solid lubricant was used as a lubricant but there is no description about the numerical values of the frictional resistance or the frictional coefficient. The size of the chipped part of the blade edge is an important factor of the cleaning failure, but the cleaning failure is largely affected by the frictional resistance, and therefore, it is also necessary to define the frictional resistance.

Although it is described in JP-A No. 2001-005359 that the cleaning failure occurred when the chipped part of the blade edge had a depth of from 10 μm to 30 μm, it is presumed that the frictional resistance was extremely high, and so more careful examination on this matter is needed.

The result is that it is important not to produce any factors to cause cleaning failure in order to perform sufficient cleaning of highly spherical toner. The surface roughness of the photoconductor, the frictional resistance, and the surface roughness of the blade edge are extremely important factors. In other words, formation of any space between the cleaning blade and the photoconductor is prevented so as not to pass the toner through the space.

JP-A No. Hei 8-044245 discloses a method of measuring torque of a photoconductor or measuring torque of a rotor in contact with the photoconductor. More specifically, this method is a method of bringing an elastic material such as blade-shaped urethane into contact with the photoconductor with no toner thereon to measure torque applied with load when the photoconductor is made to rotate. Although this method is one of methods effective in measurement of frictional resistance, it has a problem such that the measurement is not stable because the photoconductor is loaded quite heavily. Furthermore, this method is different from the measuring method in the present invention, and measured values are not described in the disclosed method.

If the frictional resistance between the photoconductor and the cleaning blade increases, the stick-slip phenomenon tends to occur. For example, toner produced by the pulverization method or produced by the polymerization method is hard to be cleaned off, which results in degradation of quality of an image on a copied sheet, that is, background stains appear on the image. More specifically, the toner produced by the pulverization method indicates irregular-shaped toner particles having an average sphericity of from about 0.91 to about 0.94 including particles of from about 1 μm to about 3 μm. The toner produced by the polymerization method indicates large spherical toner particles having an average sphericity of from about 0.98 to about 1.0.

Since an engaging force of the cleaning blade to the photoconductor increases, the surface of the photoconductor is damaged, and 10-point average roughness RzJIS as the surface roughness and its maximum height Rz increase, which causes uneven streaks or the like to occur on an image. Furthermore, since the engaging force increases, abrasion of the photoconductive layer is speeded up, which causes scratches to occur and the surface roughness to increase. It is thereby difficult to maintain durability of the photoconductor, and therefore, the life becomes shorter.

The engaging force causes the cleaning blade edge to be worn or easily chipped, streak-like cleaning failure to occur, and overall cleaning failure to easily occur.

The adhesion of the corona product materials to the photoconductive layer is suppressed. Therefore, they are not removed, and a surface frictional resistance rate on the surface layer of the photoconductor lowers, which causes degradation of image quality such as image flow to easily occur.

Since the corona product materials are adhered to the cleaning blade, the blade edge is easily hardened caused by its chemical degradation and easily chipped. The life of the blade is shortened and cleaning failure occurs, which causes streak patterns to easily occur on an image.

The increased engaging force may cause a drum to make unpleasant so-called squeaking noise.

As explained above, if the frictional resistance between the photoconductor and the cleaning blade becomes high, various problems occur. The image quality is thereby degraded, and the life of both the photoconductor and cleaning member is also shortened.

SUMMARY OF THE INVENTION

It is an object of the present invention to solve at least the problems in the conventional technology.

An image forming apparatus according to an aspect of the present invention forms an image using an electrophotographic process. The image forming apparatus includes a photoconductor that includes at least a conductive support, an undercoat layer, and a photoconductive layer, wherein the photoconductor has a surface roughness of either of a 10-point average roughness RzJIS of 0.1 μm≦RzJIS≦1.5 μm and a maximum height Rz of 2.5 μm or lower; a charger that charges the photoconductor; a developing device that develops a latent image on the photoconductor with toner to obtain a toner image; a transfer device that transfers the toner image to a transfer element; a cleaning device including a cleaning blade that cleans off toner remaining on the photoconductor after the toner image has been transferred; a belt that is suspended in a circumferential direction of the photoconductor, wherein a 100-gram load is hanged at one end of the belt so that a contact length thereof with the photoconductor is 3 mm and a contact area is 15 mm2, the belt is a polyurethane flat type, the belt has a JIS-A hardness of 83 degrees, width of 5 mm, a length of 325 mm, a thickness of 2 mm, and a dead weight of 4.58 grams, a frictional resistance Rf of the photoconductor against the belt is 45 gram-force<Rf<200 gram-force, the frictional resistance Rf measured under such conditions that a value obtained by subtracting the 100-gram load from the read value of the digital force gauge is determined as the frictional resistance Rf; and a digital force gauge that is fixed to another end of the belt and a value is read from the digital force gauge when the belt moves.

A process cartridge according to another aspect of the present invention includes a cartridge case that is detachably mounted in an image forming apparatus accommodates at least a photoconductor and a cleaning device of an image forming apparatus. The image forming apparatus forms an image using an electrophotographic process and includes a photoconductor that includes at least a conductive support, an undercoat layer, and a photoconductive layer, wherein the photoconductor has a surface roughness of either of a 10-point average roughness RzJIS of 0.1 μm≦RzJIS≦1.5 μm and a maximum height Rz of 2.5 μm or lower; a charger that charges the photoconductor; a developing device that develops a latent image on the photoconductor with toner to obtain a toner image; a transfer device that transfers the toner image to a transfer element; a cleaning device including a cleaning blade that cleans off toner remaining on the photoconductor after the toner image has been transferred; a belt that is suspended in a circumferential direction of the photoconductor, wherein a 100-gram load is hanged at one end of the belt so that a contact length thereof with the photoconductor is 3 mm and a contact area is 15 mm2, the belt is a polyurethane flat type, the belt has a JIS-A hardness of 83 degrees, width of 5 mm, a length of 325 mm, a thickness of 2 mm, and a dead weight of 4.58 grams, a frictional resistance Rf of the photoconductor against the belt is 45 gram-force<Rf<200 gram-force, the frictional resistance Rf measured under such conditions that a value obtained by subtracting the 100-gram load from the read value of the digital force gauge is determined as the frictional resistance Rf; and a digital force gauge that is fixed to another end of the belt and a value is read from the digital force gauge when the belt moves.

A method of forming an image according to still another aspect of the present invention uses an image forming apparatus to form the images. The image forming apparatus forms an image using an electrophotographic process and includes a photoconductor that includes at least a conductive support, an undercoat layer, and a photoconductive layer, wherein the photoconductor has a surface roughness of either of a 10-point average roughness RzJIS of 0.1 μm≦RzJIS≦1.5 μm and a maximum height Rz of 2.5 μm or lower; a charger that charges the photoconductor; a developing device that develops a latent image on the photoconductor with toner to obtain a toner image; a transfer device that transfers the toner image to a transfer element; a cleaning device including a cleaning blade that cleans off toner remaining on the photoconductor after the toner image has been transferred; a belt that is suspended in a circumferential direction of the photoconductor, wherein a 100-gram load is hanged at one end of the belt so that a contact length thereof with the photoconductor is 3 mm and a contact area is 15 mm2, the belt is a polyurethane flat type, the belt has a JIS-A hardness of 83 degrees, width of 5 mm, a length of 325 mm, a thickness of 2 mm, and a dead weight of 4.58 grams, a frictional resistance Rf of the photoconductor against the belt is 45 gram-force<Rf<200 gram-force, the frictional resistance Rf measured under such conditions that a value obtained by subtracting the 100-gram load from the read value of the digital force gauge is determined as the frictional resistance Rf; and a digital force gauge that is fixed to another end of the belt and a value is read from the digital force gauge when the belt moves.

The other objects, features, and advantages of the present invention are specifically set forth in or will become apparent from the following detailed descriptions of the invention when read in conjunction with the accompanying drawings.

Photograph 1 is a photographed state of a lubricant unevenly applied to the photoconductor; and Photograph 2 is a photographed state of a lubricant evenly applied to the photoconductor.

DETAILED DESCRIPTION

Exemplary embodiments of an image forming apparatus, a process cartrage, and a method of forming an image according to the present invention are explained in detail below with reference to the accompanying drawings.

Figure 1:
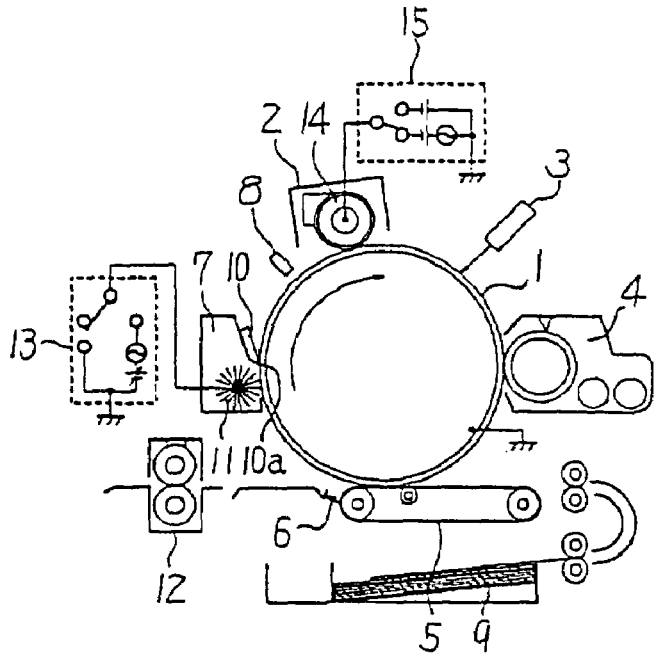
FIG. 1 is a schematic side view of a basic configuration of an electrophotographic process in a printer according to an embodiment of the present invention.

The image forming apparatus according to one embodiment is applied to a printer using an electrophotographic process. FIG. 1 is a schematic side view of a basic configuration of the electrophotographic process in the printer. A drum-shaped photoconductor 1 as a main process of the electrophotographic process is rotatably disposed. Arranged around the photoconductor 1 are electrophotographic process members such as a charger 2, an image exposing device 3, a developing device 4, a transfer device 5, a separator 6, a cleaning device 7, and a decharger 8 in this order according to the electrophotographic process.

The charger 2 charges the surface of the photoconductor 1 to a charging potential required for image formation, and either a contact charger or a non-contact charger is used for the charger 2. As a charging member, a charging roller 14 in contact with the photoconductor 1 is used as shown in FIG. 1. The charging roller (charging member) 14 is connected with a high-voltage power supply 15 for charging that applies a dc voltage or a dc voltage with an ac voltage superposed thereon.

The image exposing device 3 reads a document image by a charge-coupled device (CCD) of a scanner, exposes the surface of the photoconductor 1 based on image data obtained by subjecting the read image to image processing for a dot pattern or image data from a personal computer or the like, and thereby forms an electrostatic latent image (electrostatic contrast). The image exposing device 3 includes a semiconductor laser device or a light emitting diode (LED) array as a light source.

The developing device 4 contains two-component developer including toner and carrier to develop the electrostatic latent image on the photoconductor 1 using a magnetic brush method. The transfer device 5 transfers a developed toner image on the photoconductor 1 to a transferred element 9 such as a transfer paper, an overhead projector (OHP) sheet, or an intermediate transfer element.

The separator 6 electrostatically separates the transferred element 9 from the photoconductor 1. The cleaning device 7 cleans off residual powder such as toner remaining on the photoconductor 1 after a transfer process. The cleaning device 7 includes a cleaning blade 10 (hereinafter, "blade 10") singly or the blade 10 with a cleaning brush 11 (hereinafter, "brush 11") that is made of looped fibers. A thermal fixing device 12 fixes the toner image on the transferred element 9 and is disposed at the downstream side of transfer and separation positions in a paper conveying direction.

Figure 2:
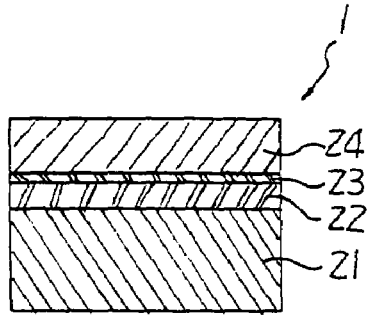
FIG. 2 is a cross section of an exemplary photoconductor.

An exemplary cross-section of the photoconductor 1 is shown in FIG. 2. The photoconductor 1 includes a conductive support 21, an undercoat layer 22, a charge generation layer 23, and a charge transport layer 24. If high durability is required, a high abrasion-resistance photoconductive layer (e.g., a filler-containing charge transport layer 25 in FIG. 3) may further be formed on the charge transport layer.

For the conductive support 21, any support is usable if it exhibits conductive characteristics of $10^6$ ohm-centimeters or less, but it is preferable to use a JIS-3003 aluminum alloy drum having a thickness of from 0.6 mm to 3 mm and an outer diameter of from 25 mm to 100 mm.

The undercoat layer 22 uses a material so as to prevent an increase in residual potential and is formed to ensure charging potential required for image formation, electrostatic contrast, and an uniform image (prevention of moiré or reproduction of dot pattern). The thickness of the undercoat layer 22 is from about 1 μm to about 10 μm, preferably from 3 μm to 5 μm.

Resin used for the undercoat layer 22 includes water soluble resin such as polyvinyl alcohol, casein, and sodium polyacrylate; alcohol soluble resin such as copolymer nylon and methoxymethylated nylon; and setting type resin for forming three-dimensional network structure such as polyurethane resin, melamine resin, alkyd-melamine resin, and epoxy resin. Further, the resin may disperse and contain powder of metal oxide, metallic sulfide, or metallic nitride. The metal oxide includes titanium oxide, silica, alumina, zirconium oxide, tin oxide, and indium oxide. The undercoat layer 22 made of any of the materials is formed by using appropriate solvent and coating method. Furthermore, a metal oxide layer is effective for the undercoat layer 22. The metal oxide is formed with a silane coupling agent, a titanium coupling agent, or a chromium coupling agent using, for example, sol-gel method.

The charge generation layer 23 generates electrons and holes required for image formation through image exposure. The charge generation layer 23 is desirably in a state such that the holes generated by light for write of the image exposing device 3 move to the surface layer of the photoconductor 1 so that the holes can easily be coupled to surface charges. In other words, it is desirable to use a material such that a high barrier is not formed on an interface between the charge generation layer 23 and charge transport layer 24 so that the holes can not jump over it. Any material can be used for the photoconductor 1 of the embodiment if it meets the requirements regardless of inorganic or organic materials.

An inorganic charge generation material includes crystalline selenium, amorphous selenium, selenium-tellurium, selenium-tellurium-halogen, selenium-arsenium compound, and amorphous silicon.

An organic charge generation material includes phthalocyanine pigments such as metallophtalocyanine and metal-free phtalocyanine, an azulenium salt pigment, a squaric acid methyl pigment, an azo pigment having a carbazole skeleton, an azo pigment having a triphenylamine skeleton, an azo pigment having a diphenylamine skeleton, an azo pigment having a dibenzothiophene skeleton, an azo pigment having a fluorenone skeleton, an azo pigment having a oxadiazole skeleton, an azo pigment having a bisstilbene skeleton, an azo pigment having a distyryl oxadiazole skeleton, an azo pigment having a distyryl carbazole skeleton, a perylene pigment, an anthraquinone or polycyclic quinone pigment, a quinoneimine pigment, diphenyl methane and triphenyl methane pigments, benzoquinone and naphthoquinone pigments, cyanine and azomethine pigments, an indigoid pigment, and a bisbenzimidazole pigment.

Binder resin used for the charge generation layer 23 includes polyamide, polyurethane, epoxy resin, polyketone, polycarbonate, polyarylate, silicone resin, acrylic resin, polyvinyl butyral, polyvinyl formal, polyvinyl ketone, polystyrene, poly-N-vinyl carbazole, and polyacrylamide. These binder resins are used alone or in combination. Alternatively, a low-molecular charge transport material (electron transport material or hole transport material) may be added thereto.

Examples of the electron transport material include electron acceptor materials such as chloranil; bromanil; tetracyanoethylene; tetracyanoquinodimethane; 2,4,7-trinitro-9-fluorenone; 2,4,5,7-tetranitro-9-fluorenone; 2,4,5,7-tetranitroxanthone; 2,4,8-trinitrothioxanthone; 2,6,8-trinitro-4H-indeno [1,2-b]thiophene-4-on; 1,3,7-trinitrodibenzothiophene-5,5-dioxide. These electron transport materials can be used alone or in combination.

The hole transport material includes electron donor materials as follows which are used appropriately. Examples thereof include oxazole derivatives, oxadiazole derivatives, imidazole derivatives, triphenylamine derivatives, 9-(p-diethyl aminostyrylanthracene), 1,1-bis-(4-dibenzylamionophenyl)propane, styrylanthracene, styrylpyrazoline, phenyl hydrazones, α-phenylstilbene derivatives, thiazole derivatives, triazole derivatives, phenazine derivatives, acridine derivatives, benzofuran derivatives, benzimidazole derivatives, and thiophene derivatives. These holes transport materials are use alone or in combination.

The charge generation layer 23 is formed of a material containing a charge generation material, solvent, and binder resin as main components, and the material may include any additives of an intensifier, a dispersant, a surface active agent, and silicone oil.

A method of forming the charge generation layer 23 includes typically a method of forming a vacuum thin film and a casting method based on a solution dispersion system. The former method includes a vacuum evaporation method, a glow discharge decomposition method, an ion plating method, a spattering method, a reactive spattering method, and a chemical vapor deposition (CVD) method. By using any of the methods, the inorganic and organic materials are satisfactorily formed.

In order to form the charge generation layer 23 by the casting method, the process as follows is executed. That is, the inorganic or organic charge generation material is dispersed using a solvent such as tetrahydrofuran, cyclohexanone, dioxane, dichloroethane, or butanone, with binder resin if necessary, by a ball mill, an attritor, or a sand mill, and a dispersed liquid is appropriately diluted and applied. The application is performed by using the dip coating method, spraying method, or a bead coating method.

An appropriate film thickness of the charge generation layer 23 is from about 0.01 μm to about 5 μm, preferably from 0.05 μm to 2 μm. Generally, the film thickness is from 0.1 μm to 0.3 μm. If the film is too thin, sensitivity failure occurs, but if it is too thick, light attenuation and degradation due to space charges occur and residual potential rises, which degrades image quality, that is, image density and resolution become low.

The charge transport layer 24 is formed to ensure sufficient charging potential and sufficient contrast potential required for image formation. The charge transport layer 24 includes polycarbonate resin (A type, C type, and Z type), styrene resin, or amorphous polyolefine which are used as binder resin. More specifically, the resins are generally less polarity-dependent, and have a volume resistivity of from about $10^{14}$ to about $10^{18}$ ohm-centimeters. Furthermore, a donor, an antioxidant, or a leveling material is added to the binder resin.

As a low-molecular charge transport material forming the charge transport layer 24, oxazole derivatives, oxadiazole derivatives, imidazole derivatives, triphenylamine derivatives, α-phenylstilbene derivatives, triphenyl methane derivatives, and anthracene derivatives are used.

On the other hand, as a polymer charge transport material, known ones as follows are used. For example:

1) Polymer having a carbazole ring in its principal chain and/or side-chain includes, for example, poly-N-vinyl carbazole, and compounds described in JP-A No. Sho 50-82056, JP-A No. Sho 54-9632, JP-A No. Sho 54-11737, and JP-A No. Hei 4-183718.
2) Polymer having a hydrazone structure in its principal chain and/or side-chain includes, for example, compounds described in JP-A No. Sho 57-78402, and JP-A No. Hei 3-50555.
3) Polysilylen polymer includes, for example, compounds described in JP-A No. Sho 63-285552, JP-A No. Hei 5-19497, and JP-A No. Hei 5-70595.
4) Polymer having a tertiary amine structure in its principal chain and/or side-chain includes, for example, N,N-bis (4-methylphenyl)-4-amino polystyrene, and compounds described in JP-A No. Hei 1-13061, JP-A No. Hei 1-19049, JP-A No. Hei 1-1728, JP-A No. Hei 1-105260, JP-A No. Hei 2-167335, JP-A No. Hei 5-66598, and JP-A No. Hei 5-40350.
5) Another polymer includes, for example, formaldehyde condensation polymer of nitropyrene, and compounds described in JP-A No. Sho 51-73888, and JP-A No. Sho 56-150749.

As the polymer having an electron-donating group used in the embodiment, not only the above polymers but also those as follows can be used. That is, they are known monomeric copolymers, a block polymer, a graft polymer, a star polymer, or a cross-linked polymer having an electron-donating group disclosed in, for example, JP-A No. Hei 3-109406.

As the polymer charge transport material in the embodiment, polycarbonate having a triarylamine structure in its principal chain and/or side-chain is effectively used.

On the other hand, examples of a polymer compound used as a binder component include thermoplastic or thermosetting resins such as polystyrene, styrene-acrylonitrile copolymer, styrene-butadiene copolymer, styrene-maleic anhydride copolymer, polyester resin, polyvinyl chloride, vinyl chloride-vinyl acetate copolymer, polyvinyl acetate, polyvinylidene chloride, polyarylate resin, polycarbonate resin (bisphenol A type, bisphenol C type, bisphenol Z type, or copolymer of these), cellulose acetate resin, ethyl cellulose resin, polyvinyl butyral polyvinyl formal, polyvinyl toluene, acrylic resin, silicone resin, fluororesin, epoxy resin, melamine resin, urethane resin, phenol resin, and alkyd resin, but the polymer compound is not limited to these. These polymer compounds are used alone or in combination, or are copolymerized with a charge transport material for use.

Examples of a dispersion solvent for use in preparation of coating liquid for the charge transport layer include a ketone group such as methyl ethyl ketone, acetone, methyl isobutyl ketone, and cyclohexanone; an ether group such as dioxane, tetrahydrofuran, and ethylcellosolve; an aromatic group such as toluene and xylene; a halogen group such as chlorobenzene and dichloromethane; and an ester group such as ethyl acetate and butyl acetate. However, it is desirable to avoid using halogen type solvents because they may be harmful to environments.

To improve environment resistance and prevent a fall of sensitivity and a rise of residual potential, it is possible to add an antioxidant, a plasticizer, a lubricant, an ultraviolet absorber, and a low-molecular charge transport material to each of the charge generation layer 23, the charge transport layer 24, the undercoat layer 22, a protective layer, and an intermediate layer.

The film thickness of the charge transport layer 24 is set to from about 10 μm to about 30 μm, because if the film thickness is 10 μm or less, a surface potential required for image formation cannot be secured. As a contrast potential for image formation, at least 250 volts is required, because if the film thickness is 10 μm or less, the contrast potential becomes low and an irregular film thickness becomes significant, which makes it difficult to keep image quality with a satisfactory signal-to-noise (SN) ratio.

On the other hand, a thicker charge transport layer 24 allows a satisfactory surface potential to be ensured, which obtains an allowable margin for image quality with the satisfactory SN ratio. However, since structural defects increase in the photoconductive layer if the film thickness is made higher, unfavorable phenomena such as a residual image easily occur. In addition, uniformity of the film quality is lowered and manufacturing cost is increased. Generally, 500 volts is adequate for a contrast potential required for image formation, and the surface potential of the photoconductor at this time is about 800 volts. The film thickness of 30 μm is adequate for charging the photoconductor layer to 800 volts, and the thickness of that value or more is not preferable because the phenomena may occur.

The surface roughness of the photoconductor 1 preferably ranges from 0.1 μm to 1.0 μm based on 10-point average roughness RzJIS (JIS B 0601). This is because sharp image quality is obtained and cleaning failure due to distortion of the blade edge is prevented when the blade 10 comes in contact with the photoconductor 1.

When highly spherical toner is used, even if the edge of the blade 10 is slightly distorted during operation of a printer (image forming apparatus), the spherical toner slides into a distorted part. Therefore, it is important to reduce factors (defects) that cause cleaning failure, as less as possible when the spherical toner is used.

Since the charge transport layer 24 of the organic photoconductor 1 is in direct contact with the blade 10 and the developer, the photoconductor 1 withstands about 50,000 to about 80,00 sheets as the A4-size paper. This durability is adequate when it is generally used.

However, if the number of copied sheets is increased, the exchange frequency of the photoconductor 1 (or a process cartridge explained later) increases. Therefore, it is desirable to give the photoconductor 1 higher durability. In order to increase durability, it is required to improve abrasion resistance of the photoconductor 1 while ensuring electrophotographic characteristics. This purpose is achieved by using a method of adding a high hardness filler having high transmittance to the photoconductive layer so that charging capability is ensured without sacrificing the sensitivity in the photoconductive layer and the abrasion resistance is achieved without abnormal accumulation of residual potential.

In other words, as a way to ensure electrophotographic characteristics and obtain sufficient contrast potential, a coating liquid is coated 1 μm to 10 μm on the charge transport layer 24. The coating liquid is obtained by mixing a filler and an additive as a property improvement agent, in the binder resin.

In order to form a new thin film on the photoconductor using a solvent, although usable solvent is restricted, there are such advantages that the abrasion resistance can be set according to the type of filler to be added and the amount of its addition, and that even if another photoconductive layer with the filler added thereto is formed on the charge transport layer 24, a barrier is hardly formed on the interface between the layers. Therefore, electrophotographic properties that stand repeated use is obtained. Furthermore, since resin is used, the surface layer is appropriately scraped by a contact member such as the blade 10. Therefore, it is possible to minimize degradation of the electrophotographic properties represented by image flow as compared with that of the photoconductor having the protective layer. Furthermore, the spraying method can be used, and therefore, the layer is more easily formed at reduced cost as compared with the other methods.

Figure 3:
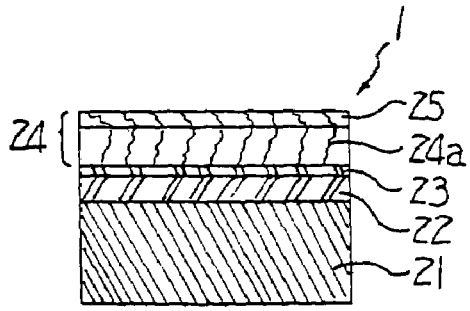
FIG. 3 is a cross section of another exemplary photoconductor.

FIG. 3 is an illustration of a cross-sectional layer structure of the photoconductor 1 having a photoconductive layer with dispersed filler (filler-containing charge transport layer 25).

A resin liquid is obtained by uniformly dispersing an appropriate amount of filler and a dispersing agent and donor into the binder resin. The resin liquid is coated on the photoconductor 1 having the layer structure of FIG. 2 using the spraying method or the dip coating method. The particle size and amount of filler to be added are set in a range in which the durability and the electrophotographic properties such as charging characteristics, sensitivity, and image quality are not lost.

The filler to be added is an inorganic filler such as alumina ($\alpha$-$Al_2O_3$) and titanium oxide having a volume resistivity ranging from $1\times10^{10}$ to $1\times10^{5}$ ohm-centimeters and an average primary particle size ranging from 0.01 μm to 1.0 μm, preferably from 0.02 μm to 0.5 μm. The filler of 1 wt % to 40 wt %, preferably 15 wt % to 30 wt % with the donor and the dispersing agent is dispersed into the resin the same as the binder resin of the charge transport layer 24 to form the filler-containing charge transport layer 25.

Although the film thickness of the filler-containing charge transport layer 25 is different depending on the dispersed filler or required durability, it is generally from 2 μm to 10 μm, preferably from μm 3 to 8 μm, and the total film thickness of a charge transport layer 24*a* and the filler-containing charge transport layer 25 is set to from 10 μm to 30 μm. In other words, the filler-containing charge transport layer 25 is a part of the charge transport layer 24. Therefore, even if the filler is dispersed into the resin, it is desirable that the electrophotographic properties other than mechanical strength are kept to the same as the electrophotographic properties before addition of the filler. Furthermore, it is important that a barrier is not formed between the charge transport layer 24*a* and the filler-containing charge transport layer 25 so that the holes freely move. In other words, it is desirable to use the same materials as those for the binder resin, donor, and solvent used for the charge transport layer 24*a* and the filler-containing charge transport layer 25.

It is desirable that the surface resistivity of the photoconductor 1 after lamination of the filler-containing charge transport layer 25 is about $1\times10^{15}$ to about $1\times10^{17}$ ohms per square and the volume resistivity thereof is about $1\times10^{13}$ to about $1\times10^{15}$ ohm-centimeters. The durability of the photoconductor 1 produced in the above manner is in a range from about 100,000 to about 300,000 sheets as the A4-size paper, and higher durability is ensured if the image formation is performed under less hazardous conditions.

The photoconductive layer is coated using the dip coating method or the spraying method, and the state of the surface of the photoconductive layer affects image quality. If the surface roughness such as the 10-point average roughness RzJIS and its maximum height Rz is too high, uniformity of an image is lost and cleaning capability of the residual powder after transfer process is lowered. On the other hand, if the surface roughness is too low such as 0.1 μm or less, the photoconductor and the blade are in contact with each other too tightly, which causes some trouble in rotation. Therefore, it is desirable to keep the surface roughness of the photoconductor in a predetermined range from the initial stage to the end of the photoconductor.

If the surface roughness exceeds the predetermined range, cleaning failure of residual powder after transfer process such as toner, paper dust, and of carrier may easily occur, which causes image quality to be degraded, abrasion of the cleaning blade to be speeded up, and the edge to be chipped easily. In order to prevent cleaning failure, it is required to suppress the 10-point average roughness RzJIS to a range from 0.1 μm to 1.5 μm or the maximum height Rz to 2.5 μm or lower. In order to obtain high-definition image in particular, the filler whose weight average particle size is from 0.2 μm to 0.7 μm is adequately used for the filler-containing charge transport layer 25. The photoconductive layer is coated so that the surface roughness thereof obtained after being coated and thermally dried (before used) is from about 0.1 μm to about 0.5 μm based on the 10-point average roughness RzJIS.

The reason is that toner like pulverized toner includes many toner particles of about 1 μm even among toner particles having a weight average particle size of 4 μm. Therefore, if the surface roughness is high, small-sized toner particles pass through spaces between the photoconductor and the toner particles to cause cleaning failure to occur. If toner particles are produced using the polymerization method to obtain the toner particles having comparatively averaged particle sizes, the toner particles roll along the surface and slide into even small spaces. Therefore, the cleaning failure more easily occurs than the pulverized toner.

The surface roughness is one of the significant factors that cause cleaning failure, but there is another factor that is frictional resistance between the photoconductor and the cleaning blade. The organic photoconductor and a polyurethane rubber blade are in tight contact with each other, and therefore the frictional resistance is extremely high.

The 10-point average roughness RzJIS becomes higher because the surface is scraped as copying is performed more times. However, there is also a case where the roughness becomes too high to keep image quality such as sharpness, which causes influence over cleaning capability of residual powder after transfer process.

The cleaning failure depends on the surface resistance of the photoconductor 1 and the surface roughness (chipped part) of the edge of the blade 10. When the surface roughness of the photoconductor 1 is high, highly spherical polymer toner is affected by even a small amount of distortion of the edge and the stick-slip phenomenon. Therefore, it is required to set the system condition so as not to increase the surface roughness as much as possible.

On the other hand, if the surface roughness is too low (0.1 μm or lower), a contact between the photoconductor 1 and the blade 10 is too tight, and a contact area of the blade 10 increases, causing the stick-slip phenomenon and distortion to easily occur in the blade 10. Furthermore, the rotation of the photoconductor 1 may be troubled, and it is therefore desirable to arrange the surface roughness to be at least 0.1 μm or higher.

Therefore, it is important that the surface roughness of the photoconductor 1 is maintained within a predetermined range. If the surface roughness is high, even a small amount of distortion of the blade 10 brings about cleaning failure, which causes abrasion of the blade 10 to be speeded up and the edge to be easily chipped.

The cleaning device 7 basically includes only the blade 10. However, if spherical toner having a high sphericity of 0.98 or higher is used, it is preferable to use the brush 11 with the blade 10. The edge 10*a* of the blade 10 in contact with the photoconductor 1 is degraded while being used many times and may be chipped, causing cleaning failure to easily occur. However, pre-cleaning is performed on the photoconductor 1 by the brush 11 to reduce toner, toner blocks, and scraped filler that are flown to the blade 10 as less as possible. It is thereby possible to reduce the load of the blade 10, decrease chips of the edge 10*a*, and achieve durability.

Figure 4:
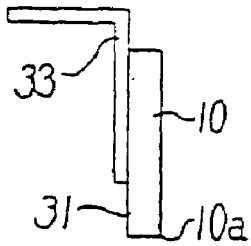
FIG. 4 is a side view of an exemplary cleaning blade.
Figure 5:
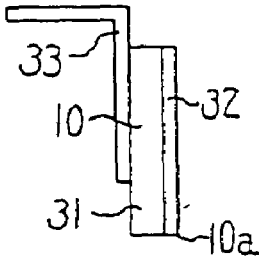
FIG. 5 is a side view of of another exemplary cleaning blade.
Figure 6:
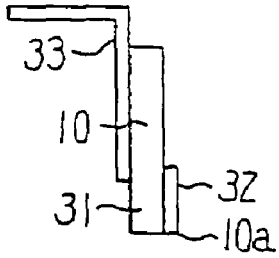
FIG. 6 is a side view of of still another exemplary cleaning blade.

The blade 10 is explained below with reference to FIG. 4. Polyurethane rubber 31 having JIS-A hardness of from 70 to 90 degrees is used over the whole blade 10. Alternatively, urethane rubber 32 having JIS-A hardness of from 70 to 90 degrees may be bonded to another elastic material such as chloroprene rubber to form configurations as shown in FIG. 5 and FIG. 6, respectively. A free length of from 2 mm to 10 mm s is adequate for the blade 10, and the free length is generally set to from 3 mm to 8 mm. The free length indicates an area that ranges from an edge of a support base 33 constituting the cleaning member to the edge 10*a* coming into contact with the photoconductor 1, and that is not fixed to the support base 33. (See FIG. 7 and FIG. 8)

When spherical toner having an average sphericity of from 0.97 to 1.0 is used, it is desirable to set the hardness of the blade 10 to slightly higher (from 80 to 90 degrees). If the rubber hardness is too low, the blade 10 is susceptible to the frictional resistance of the photoconductor 1, and is susceptible to distortion even if characteristic values are slightly different from one other. On the other hand, if the rubber hardness is too high, fitting capability along the surface of the photoconductor 1 is lost, and the photoconductor 1 is easily flawed. If the polyurethane rubber is bonded to another elastic material 32, the thickness of from 1 mm to 1.5 mm is adequate.

Figure 7:
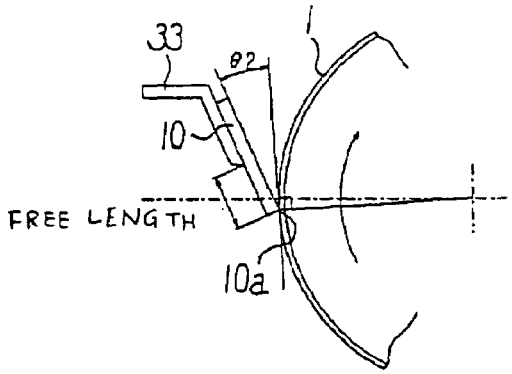
FIG. 7 is a side view of a flat-edged cleaning blade.
Figure 8:
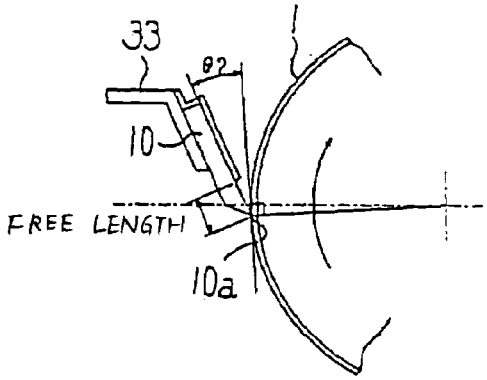
FIG. 8 is a side view of an example of a knife-edged cleaning blade.

Any material of the blade 10 having repulsion elasticity (JIS K 6301, Luepke type) of from 30% to 70% can be used, and the material having the repulsion elasticity of from about 30% to about 50% is generally used. FIG. 7 and FIG. 8 are examples of the blade 10 in contact with the photoconductor 1 in the counter direction at an angle $\theta_2$. The edge 10*a* of the blade 10 in contact with the photoconductor 1 may be flat-shaped (FIG. 7) obtained by being cut to a slip like shape or may be knife edge-shaped (FIG. 8). The angle $\theta_2$ ranges from 10 to 40 degrees and an engaging amount to the photoconductor 1 ranges from 0.5 mm to 2 mm, and generally 1 mm. A contact pressure ranges from 10 g/cm to 40 g/cm, preferably from 10 g/cm to 25 g/cm.

If the contact pressure of the blade 10 against the photoconductor 1 increases, the pressure is applied to both the blade 10 and the photoconductor 1. Therefore, the photoconductor 1 may easily be deeply flawed and the edge 10*a* of the blade 10 may easily be chipped. The contact pressure of 40 g/cm is adequate for achievement of sufficient cleaning capability. However, if 40 g/cm or more of contact pressure is usually applied to the photoconductor 1, the abrasion of the photoconductor 1 progresses, and the flaw is increased. Therefore, the contact pressure is desirably set to a value as low as possible.

On the other hand, if the contact pressure is too low, toner may easily slide into a space between the blade 10 and the photoconductor 1, causing cleaning failure. If the contact pressure is set to 10 g/cm or less, the toner cannot be suppressed by the blade 10 and cleaning capability cannot be maintained. Therefore, a desirable contact pressure is from 10 g/cm to 40 g/cm, preferably from 10 g/cm to 25 g/cm.

The surface roughness of the edge 10*a* of the blade 10 is important for maintaining the cleaning capability of toner. If the edge 10*a* is chipped and the surface roughness becomes high, streak-like cleaning failure of toner occurs.

Figure 9:
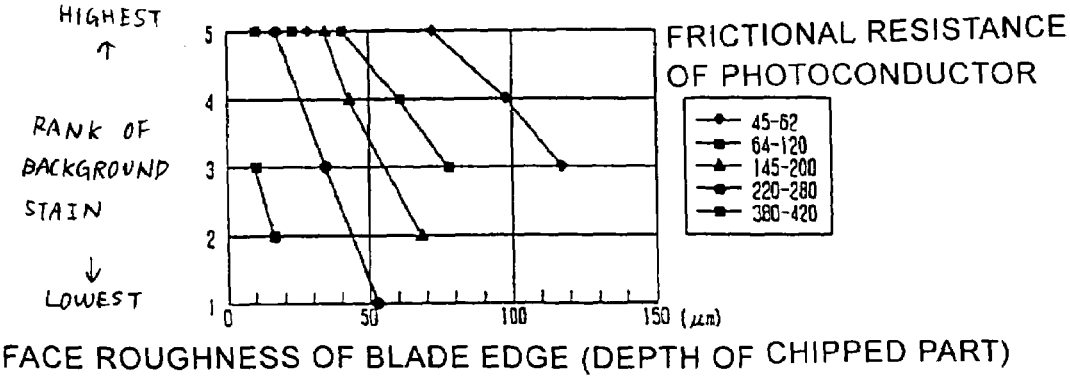
FIG. 9 is a characteristic diagram of a relation between surface roughness of the edge of the cleaning blade and cleaning capability using frictional resistance as parameters.

FIG. 9 is an illustration of a relation between the surface roughness (depth of chipped part) of the edge 10*a* and cleaning capability (expressed by ranks of background stain)

using frictional resistance (explained later) of the photoconductor 1 as parameters. Imagio MF2200 machine of Ricoh Co., Ltd. was used as an evaluating device, and a device with only the blade 10 was used as a cleaning device, and a contact pressure of the blade 10 was 23 g/cm. A developer as follows was used. That is, it was obtained by mixing polymer toner for C1616 (weight average particle size is about 6 μm) with carrier (RB021), both produced by Fiji Xerox Co., to obtain toner density of 7 wt %. For the surface roughness, the depth of a chipped part of the blade edge corresponding to a portion where a background stain occurred on a copied sheet was measured by using an ultra-depth profile measuring microscope VK8500 produced by Kience Corp.

In the ranks of the background stain on the y axis, the highest indicates "Very Good". Therefore, Rank 5 indicates no background stain observed. In order to maintain high image quality, Rank 5 is required.

The background stain becomes better when the frictional resistance of the photoconductor 1 is smaller. For example, for the image quality in Rank 5, even if only the blade 10 is used, the blade edge 10*a* has a chipped-part allowable range up to about 70 μm when the frictional resistance of the photoconductor 1 is from 45 gf to 62 gf. Even if the chipped part is spread to about 35 μm when the frictional resistance is about 200 gf, image quality without background stain is obtained. In other words, the cleaning capability is affected by the frictional resistance of the photoconductor 1 and the surface roughness (depth of chipped part) of the edge 10*a*.

It is desirable to previously coat some lubricating material on the edge 10*a* that comes into contact with the photoconductor 1. The reason is that cleaning failure at a first sheet is prevented. Because frictional resistance between the photoconductor 1 and the blade 10 is extremely high at the beginning, the photoconductor 1 is flawed or scratched when the photoconductor 1 is forced to rotate at the beginning, and the blade 10 is also chipped. If the blade 10 is chipped and the photoconductor 1 is flawed, the chip and the flaw are increased more and more, which brings about many problems on image quality.

The lubricant to be coated on the edge 10*a* is desirably fine grain fluororesin such as polytetrafluoroethylene (PTFE) or polyvinylidene fluoride (PVDF) having an average particle size of from about 0.01 μm to about 0.5 μm. Depending on cases, even toner once used for the developer is effective although its lubricating ability is inferior to the lubricant. The lubricant is coated on the blade 10 and the photoconductor 1. The blade 10 and the photoconductor 1 may be coated with powdery lubricant by rubbing them lightly with non-woven fabric or gauze. Alternatively, the lubricant may be put into a solvent such as methyl alcohol and the solvent may be applied to the blade edge with a brush.

By doing so, the photoconductor 1 is smoothly rotated, and initial degradation of the photoconductor 1 and the blade 10 is prevented.

The blade 10 is lubricated when the frictional resistance is high. Therefore, if fluororesin, silicone oil, or fluorooil is contained in the surface layer of the photoconductor 1, the frictional resistance is reduced, and therefore, the lubricant coating process is not necessary.

As for the surface roughness of the edge 10*a*, lower is better because of a contact relation between the blade 10 and the photoconductor 1. However, if it is too low, a contact between the photoconductor 1 and the blade 10 becomes tighter from their frictional resistance, and the blade 10 does not smoothly operate. Actually, if the surface roughness is 10 μm or lower, the cleaning capability is kept at a predetermined level and a space from which toner escapes is not formed. The characteristics as shown in FIG. 9 are obtained when cleaning was performed only with the blade 10, but the surface roughness of the edge 10*a* up to 70 μm is obviously allowable. In other words, if the surface roughness (chipped part) of the edge 10*a* ranges from 5 μm to 70 μm, substantially satisfactory cleaning capability is achieved even if spherical toner of about 5, 6 μm, or higher is used or the blade 10 is singly used.

The brush 11 is explained below with reference to FIG. 1. The brush 11 is disposed on the upstream side of the blade 10 in the direction of rotation of the photoconductor 1 in the cleaning device 7. The brush 11 is an auxiliary unit (pre-cleaning) of the blade 10. That is, the purpose of provision of the brush 11 is to previously reject residual powder by the blade 10 so as to prevent a large amount of residual powder from rushing toward the blade 10, and to reduce damage caused by the residual powder to as small as possible. Furthermore, contaminants including corona product materials, paper dust, and toner substance adhered to the surface of the photoconductor 1 are scraped by sliding force of the blade 10 or brush 11 to suppress detrimental effects (reduction of resolution) on image quality.

If the blade 10 and the photoconductor 1 have conditions that allow sufficient cleaning of toner, the brush 11 is not needed. However, it is preferable to provide the brush 11 for image formation over the long term.

When image formation is performed over a long period, toner is gradually fixed and adhered to the edge 10*a*, and the fixed toner is held between the photoconductor 1 and the blade 10, which causes the blade 10 or the photoconductor 1 to be damaged, or causes cleaning capability of the residual powder such as toner to be lowered. This fixing phenomenon frequently occurs if more amount of toner is conveyed to the blade 10. In other words, the toner amount is reduced by the brush 11 to reduce the load of the blade 10. Another purpose of provision of the brush 11 is to suppress adhesion of foreign matters to the photoconductor 1 and to suppress an increase in frictional resistance due to the adhesion of foreign matters.

The brush 11 for the cleaning device 7 has two types of brushes, a brush with straight fibers (cut pile brush) (hereinafter, "straight brush") and a brush with loop fibers (hereinafter, "loop brush"). The straight brush is used for almost all image forming apparatuses. The straight brush slides along the surface of the photoconductor with its tips, and the surface is thereby sharply flawed, which causes the life of the photoconductor to be shortened. On the other hand, the loop brush made of loop fabric slides along the surface of the photoconductor with sides (or backs) of the loop fabric, and therefore, the surface is hardly flawed. Thus, the loop brush is excellent in cleaning capability.

The loop brush includes an insulated brush and a conductive brush. In the embodiment, a conductive fabric brush is adequate as the brush 11. The insulated brush requires a long time to discharge even if the brush is charged. Therefore, toner and paper dust adhered to the insulated brush are not easily separated from it, and toner is easily accumulated in the apparatus, causing the cleaning efficiency to be reduced and background stains to appear on a copied image. However, in the case of the conductive brush, even if the brush is charged, it is easily discharged, and charges of toner adhered thereto are also discharged. The deficiencies pointed out with reference to the insulated brush are reduced, and degradation of copied image quality due to the brush 11 is largely suppressed.

The brush 11 is arranged so as to be in even face contact with the photoconductor 1. The engaging amount of the brush 11 to the photoconductor 1 is preferably from 1 mm to 2 mm. Uneven arrangement causes both the photoconductor 1 and the brush 11 to be worn on their respective one side. The direction of rotation of the brush 11 may be either the counter direction or the trailing direction. If a largely worn photoconductor is used, the trailing direction is adequate, while if an improved abrasion-resistance photoconductor with a filler is used, the counter direction is desirable. This is because hazards to the photoconductor are different depending on the arrangements of the brush 11 in the counter direction and the trailing direction. More specifically, abrasion of the photoconductor 1 less occurs by arranging the brush 11 in the trailing direction as compares with that in the counter direction. The number of revolutions of the brush 11 is set generally to a range from 150 to 300 revolutions per minute (rpm).

The material of the loop brush for use in cleaning includes nylon fibers, acrylic fibers, polyester fibers, and carbon fibers. The diameter of fibers used for the brush 11 is from 10 D to 20 D, density: from 24 to 48 filaments/450 loop, and length of the loop (fiber length): from 2 mm to 5 mm, where D is denier expressed by weight (g) of fiber×9000/length (m) of fiber, and a smaller value indicates a smaller diameter of fiber.

The brush 11 is the loop brush that is obtained by spirally winding a string-like loop fiber around a core metal without gap between spirally wound portions, and fixing it so as not to slide. The loop fiber is fixed by an adhesive or a double-sided adhesive tape, or by thermal fusion. By using this manufacturing method, stable and uniform cleaning capability is obtained. Since such a manufacturing method is simple, the work requires only a short time. If the double-sided adhesive tape is used, it is easy to reuse the core metal.

The photoconductor 1 is hardly flawed by the loop brush as compared with the cut pile brush with straight fibers. The surface of the photoconductor 1 having low hardness is generally more or less flawed by being slid with the blade 10, the brush 11, and the developer. If the cut pile brush with straight fibers is used, the cut faces of the tips of the fibers that rotate at from about 100 rpm to about 250 rpm hit against the photoconductor. Therefore, the photoconductor is more easily scratched (fine flaws) as compared with the loop brush, which causes abnormal images (white spots, black spots) to occur in future and the life of the photoconductor to be shortened. When the loop brush is used, the photoconductor is slid with the sides or backs of the fibers. Therefore, the photoconductor is hardly deeply scratched, and most scratches are narrow and uniform.

The loop brush preferably used in the embodiment includes SA-7 (Toray Industries, Inc.) as acrylic fibers, nylon type Belltron (nylon type fibers produced by Kanebo Ltd., Type 931 and 961), and polyester type Belltron (polyester type fibers produced by Kanebo Ltd., Type B31).

Frictional charging is produced on the brush 11 caused by sliding along the photoconductor 1, toner is easily adhered to the brush 11, and cleaning capability is gradually degraded. Therefore, the brush 11 is desirably subjected to electrical conductivity. The process for electrical conductivity is performed in fiber manufacturing stage, and some methods of performing the process are employed. One of the methods is realized by filling fibers with conductive carbon. Another one is realized by putting conductive carbon and metallic particles such as tin, gold, or titanium into resin when the resin is melted to obtain fibers. Alternatively, after the fibers are obtained, the conductive fibers may be woven with the obtained fibers.

However, if the resistance is too low, discharge from the photoconductor 1 occurs, which causes an abnormal image. Therefore, intermediate and high resistivities having from about $10^5$ to $10^{10}$ ohm-centimeters are desirable.

Both SA-7 and Belltron are conductive and each has a self-discharging capability even if they are charged, and therefore, even if toner is electrostatically attracted, the toner can be separated from the brush 11 after copying is finished. Belltron contains conductive particles such as carbon while carbon is dispersed in SA-7. Decharging capability is higher in Belltron than in SA-7, but several seconds to tens of seconds are required for charges to be sufficiently discharged.

When the brush 11 is used, the brush and a core material (metal or conductive resin) are electrically connected to each other, and it is desirable that the core material is grounded to a casing or a voltage for decharging the charges of the toner and photoconductor 1 is applied to the brush 11. The polarities of the charges of residual powder after transfer process are not uniform (both positively charged powder and negatively charged powder exist therein). Therefore, it is required to carefully grasp the situations and determine the voltage conditions. Cleaning is sometimes performed better in the case of grounding depending on system conditions.

As for the toner produced by the polymerization method, the polarities of residual charges are comparatively identical to one another even after the image transfer. Therefore, a dc voltage may be applied thereto, but considering that toner particles are charged differently, it is desirable to apply an ac voltage singly or an ac voltage with a positive voltage superposed thereon like a power supply 13 for brush as an electric circuit as shown in FIG. 1. However, it is better to ground (0V) the core material than apply the voltage thereto depending on the situations. As examples of conditions of voltage, the ac voltage is set to a range from 50 hertz to 2000 hertz and from 300 volts to 1000 volts, and the positive voltage is set to a range from about 50 volts to about 500 volts. If the voltage is excessive, abnormal charging occurs, causing image noise. Therefore, it is desirable to set the voltage to as low as possible.

Another factor, other than the surface roughness of the photoconductor 1, that causes occurrence of cleaning failure is frictional resistance of the photoconductor 1.

If polyurethane rubber is brought into face contact with an organic photoconductor, they are in absolute contact with each other, and a large magnitude of force is therefore required to separate them from each other. This is because the frictional resistance is extremely high. The edge 10*a* of the blade 10 made of polyurethane rubber is set in the counter direction so as to apply a predetermined load to the photoconductor 1. However, if excessive load is applied thereto in order to resolve cleaning failure of spherical toner, the edge 10*a* is made flat to come into face contact with the photoconductor 1. If a face contact area of the edge 10*a* becomes larger, the frictional resistance becomes higher. Therefore, a heavy load is applied to the photoconductor 1, and the photoconductor 1 is deeply flawed, the edge 10*a* is chipped, the cleaning failure is beginning to occur, and the trouble gets worse rapidly.

When the frictional resistance of the photoconductor 1 is increased, the edge 10*a* is pulled in the direction of rotation of the photoconductor 1 and is returned, so-called the stick-slip phenomenon occurs because the rubber blade 10 is not rigid. How much the edge 10*a* is pulled is affected by the hardness and elongation of the blade 10 and the magnitude of frictional resistance between the photoconductor 1 and the blade 10. If a space between the photoconductor 1 and the blade 10 occurs when the blade 10 is pulled in the direction of rotation of the photoconductor 1 and returned, cleaning failure occurs according to the size of the space. The stick-slip phenomenon tends to be decreased as the frictional resistance of the photoconductor 1 is lowered, and cleaning failure of highly spherical toner is decreased. Therefore, it is important to maintain the frictional resistance of the photoconductor 1 as low as possible.

Figure 10:
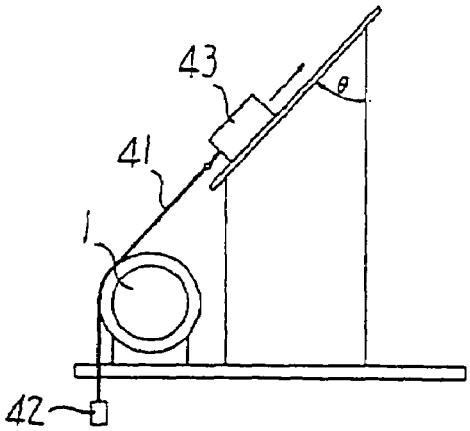
FIG. 10 is a schematic diagram of a measuring device for measuring the frictional resistance.

FIG. 10 is a schematic diagram of a measuring device in order to specify a value of the frictional resistance of the photoconductor 1. A polyurethane flat type belt (hereinafter, "flat belt") 41 having a width of 5 mm the same as that used for the blade 10 is used. The flat belt 41 is suspended in a circumferential direction of the fixed photoconductor 1 at a predetermined angle, and a contact length is set so that the flat belt 41 comes into contact with the photoconductor 1 in a range from 1 mm to 10 mm. A 100-gram load (weight 42) for bringing the flat belt 41 into tight contact with the photoconductor 1 is hanged at one end of the flat belt 41, and a digital force gauge 43 is fixed to the other end thereof. The digital force gauge 43 is used to read a load applied when the flat belt 41 is pulled.

The frictional resistance is specified as frictional resistance Rf of the photoconductor 1, by pulling the digital force gauge 43 and obtaining a value (F−W) by subtracting the load (W=100 g) of the weight from a read value (F) when the flat belt 41 moves. That is, $$Rf=F-W(gf).$$

If the contact length between the flat belt 41 and the photoconductor 1 is longer or the contact area between the two is larger, the load required for pulling becomes heavier, and an error in measurement becomes larger. Therefore, when the frictional resistance is to be measured, it is not preferable to make the contact area wide. If the flat belt 41 having a width of 5 mm is used, the contact area is about 40 $mm^2$ at most, preferably from about 10 $mm^2$ to about 15 $mm^2$.

Figure 11:
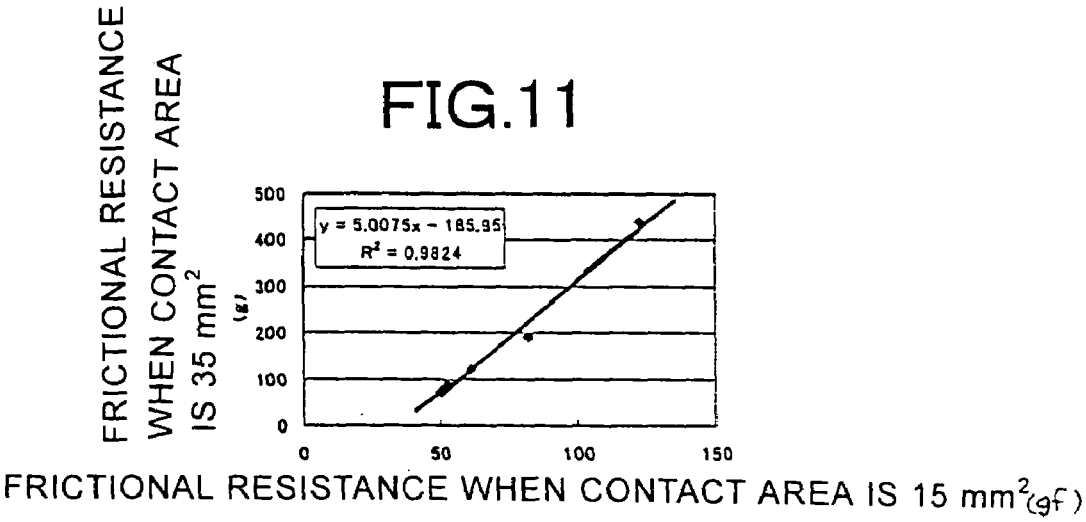
FIG. 11 is a graph of a correlation between frictional coefficients measured when contact areas are 15 $mm^2$ and 35 $mm^2$.

FIG. 11 is a graph of a relation between frictional resistances when the contact area between the flat belt and the photoconductor is set to 15 $mm^2$ and 35 $mm^2$, respectively. The relation is $$Y=5.0075X-185.95(R2=0.98)$$

where Y is a contact area of 35 $mm^2$ and X is a contact area of 15 $mm^2$.

Because a correlation between the contact areas of 15 $mm^2$ and 35 $mm^2$ is extremely high, measurement may be conducted using either of the contact areas, 15 $mm^2$ and 35 $mm^2$, but the contact area of 15 $mm^2$ is preferable because of the content described below.

The surface of the photoconductor needs slidability. A method of controlling the frictional resistance includes a method of directly applying a lubricant or indirectly applying a lubricant with an application brush, and a method of dispersing the lubricant over the surface layer of the photoconductor. The lubricant may be polytetrafluoroethylene (PTFE) film such as TOMBO9001 produced by Nichias Corp., powdery PTFE such as Lubron L-2 produced by Daikin Industries, Ltd., or silicone oil. From the viewpoint of nonuniform application, the powdery type is preferable to the liquid type, and furthermore, it is preferable to indirectly apply the powdery lubricant with the application brush, or to directly apply the PTFE film ranging from 50 μm to 200 μm that includes an elastic material therein, on the surface of the photoconductor.

Why the polyurethane flat type belt is used for measurement of the frictional resistance is because this is a practical method since polyurethane rubber is used for cleaning member.

Figure 12:
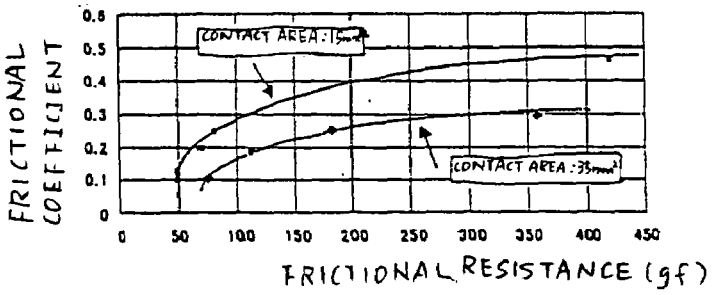
FIG. 12 is a graph of a relation between a frictional resistance and a frictional coefficient measured using Euler belt method when the contact areas are 15 $mm^2$ and 35 $mm^2$.

FIG. 12 is a graph of a relation between the frictional resistance plotted on the x axis and the frictional coefficient, measured using the Euler belt method, plotted on the y axis. The method of measuring the frictional coefficient is as follows.

The measurement is conducted by fixing a photoconductor for measurement to a base, using high quality paper having a width of 30 mm, a length of 290 mm, and a thickness of 85 μm (Type 6200 paper produced by Ricoh Co., Ltd., used in its longitudinal direction) as a belt, putting the high quality paper on the photoconductor, fixing a 100-g weight to one end of the belt, fixing a digital force gauge for measuring weight to the other end, slowly pulling the digital force gauge, reading the weight when the belt is started to move, and calculating a static frictional coefficient μs by the equation (1):

$$\mu s=2/\pi\times\ln(F/W) \quad (1)$$

where μs is static frictional coefficient, F is read load, W is weight of a weight, and π is the ratio of the circumference of a circle to its diameter.

Obviously, the line of the frictional coefficients is smoother as the frictional resistance increases, and the range to be measured becomes narrower as the contact area is larger. The contact area is 35 $mm^2$ in FIG. 12, and this means the range to be measured is narrow.

If the frictional resistance increases, the load of the photoconductor on the blade increases. Therefore, both the photoconductor and the blade become susceptible to damage and abrasion, or the blade or the photoconductive layer becomes susceptible to distortion. In other words, even if the frictional coefficient ranges from 0.3 to 0.4, which is a comparatively low level, the blade is easily distorted. Therefore, in order to keep the cleaning capability of residual powder at a satisfactory level, it is preferable that the frictional resistance is as low as possible.

The frictional resistance in the image forming apparatus is determined based on the cleaning capability of the residual powder.

Figure 13:
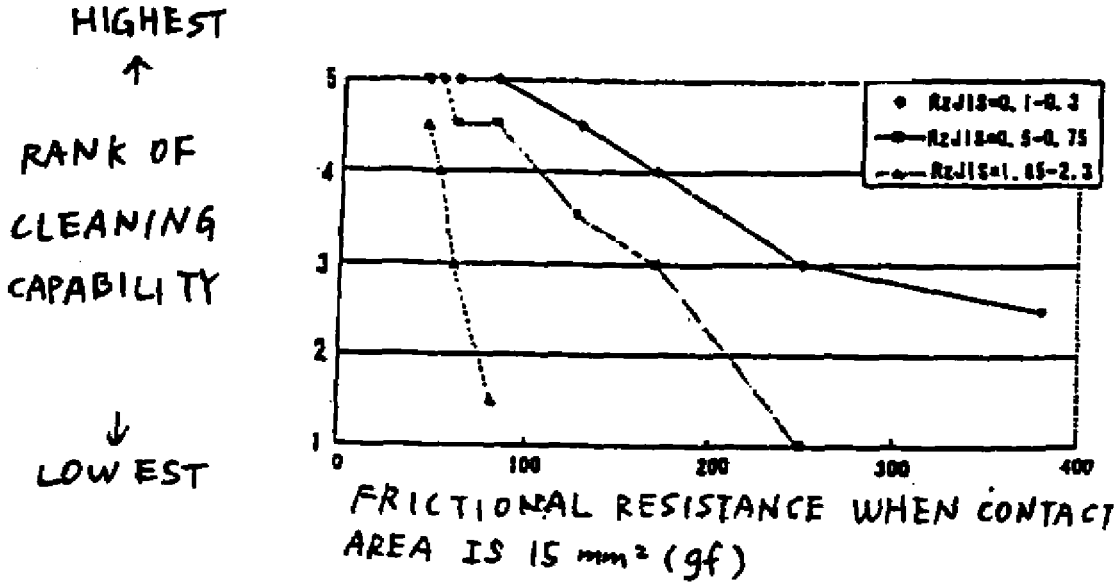
FIG. 13 is a graph of ranks of cleaning capabilities when the maximum roughness of the cleaning blade edge is 10 μm or less and when a contact area is 15 $mm^2$ at each surface roughness (Rz) of the photoconductor.
Figure 14:
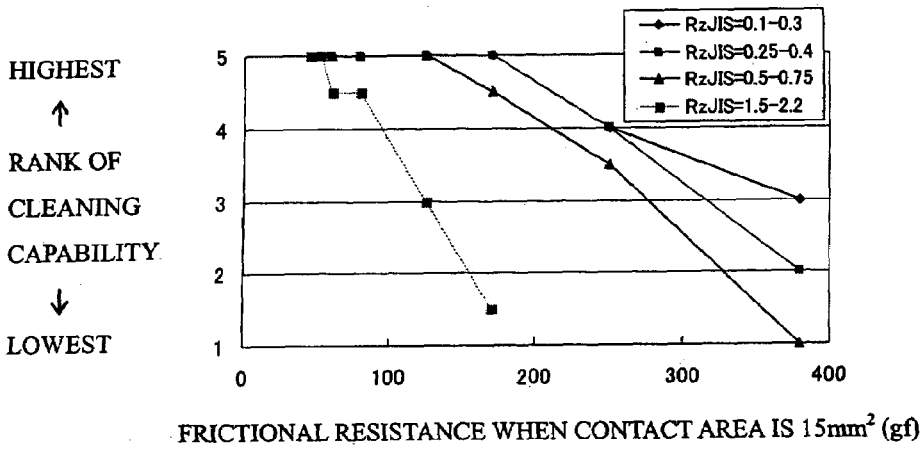
FIG. 14 is a graph of ranks of cleaning capabilities when the maximum roughness of the cleaning blade edge ranges from 40 μm to 60 μm and when a contact area is 15 $mm^2$ at each surface roughness (Rz) of the photoconductor.
Figure 14:
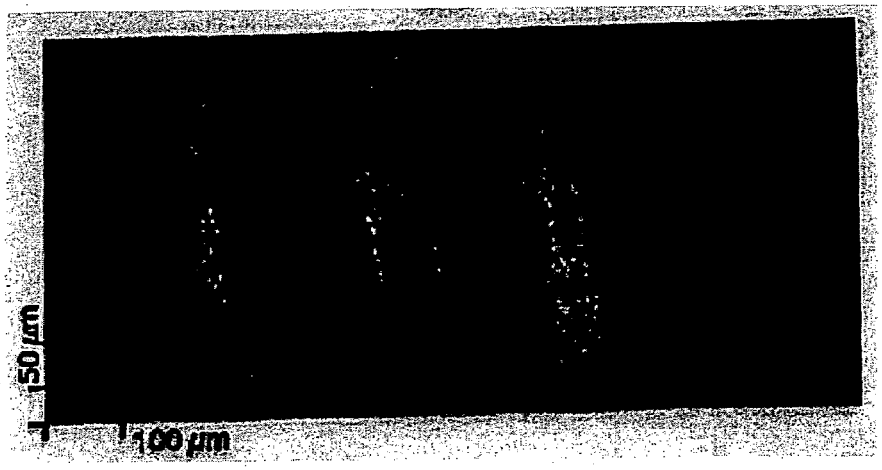
Figure 14:
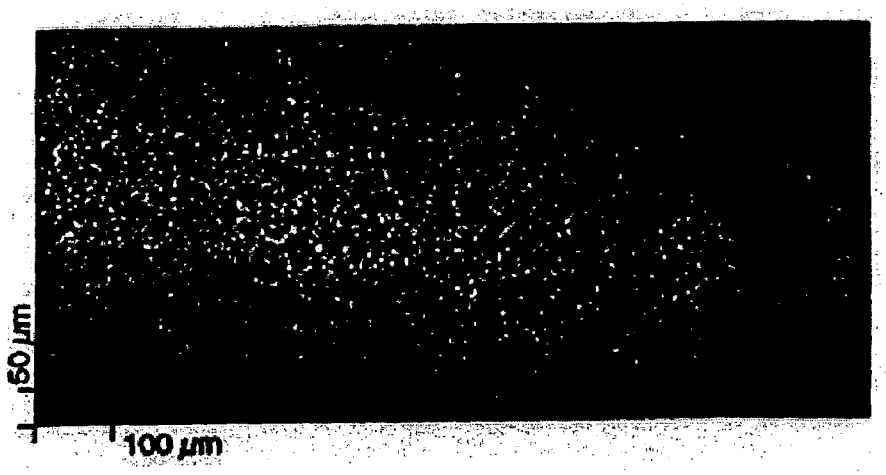

FIG. 13 and FIG. 14 are illustrations of a relation between the frictional resistance and the cleaning capability when the contact area is set to 15 $mm^2$ using the 10-point average roughness RzJIS as parameters. The cleaning capability is expressed in five ranks. FIG. 13 is a case where the maximum "valley depth" Rv of the cleaning blade edge is 10 μm or less while FIG. 14 is a case where the maximum valley depth Rv of the cleaning blade edge ranges from 40 μm to 60 μm. The cleaning capability ranks indicate the ranks of background stain on copied sheets.

The five-rank expression indicates as follows. Rank 5 indicates that cleaning capability is very good with no background stain observed, Rank 4 indicates that spotted background stains slightly appears although there is no problem practically, and thereafter, Ranks lower as the density and width of the background stain increase, and Rank 1 is the lowest. Rank 4 or higher is desirable, preferably Rank 5. Rank 5 is necessary for achieving high quality image.

The toner used is spherical toner (toner 1616 produced by Fuji Xerox Co., Ltd.) that is produced in the polymerization method, and the image forming apparatus is Imagio MF2200 produced by Ricoh Co., Ltd.

The maximum valley depth Rv is obtained by reading a numerical value obtained through measurement of a valley as a chipped part of the blade edge over an area with a specified length, using an optical microscope.

The cleaning capability of the residual powder depends on the surface roughness of the photoconductor and the state of the blade edge. If the frictional resistance is lower, the cleaning capability is better, while if the frictional resistance is higher, the cleaning capability is worse.

From the facts, the following is preferable as an allowable range of the frictional resistance Rf:

$$45(gf)<Rf<200(gf)$$

In other words, if the frictional resistance Rf is 45 gf or lower, the cleaning capability is very good, but the image formation capability is not good enough because it causes slippage of toner or image flow. If the frictional resistance Rf is 200 gf or higher, the image formation capability is good but the cleaning capability is not good because it enters into a level at which the stick-slip phenomenon may easily occur and the probability of occurrence of cleaning failure becomes high.

When the cleaning blade is used many more times, its edge in contact with the photoconductor may be more worn or chipped. If the edge is uniformly worn, no particular problem occurs, but if the edge is chipped, cleaning failure may occur according to the size of the chipped part. If the frictional resistance is 50 gf or 60 gf which is comparatively low, an allowable range of the valley depth of the edge is widened, but if the frictional resistance is becomes high, the allowable range is narrowed.

In order to perform cleaning satisfactorily on residual powder, it is desirable that the frictional resistance is 200 gf or lower, the maximum valley depth is 40 μm or less from the results with reference to FIG. 13 and FIG. 14, preferably 30 μm or less. On the other hand, a preferable minimum value of the valley depth of the cleaning blade is 0 μm. However, if the surface roughness ranges from 0.1 to 0.2 which is sufficiently low and the frictional resistance is 45 gf which is sufficiently low, then the cleaning blade has satisfactory cleaning capability even if the maximum valley depth is about 90 μm, but this state is difficult to maintain stable image formation capability.

Another specific example of the measurements is explained below. Assume that there is the flat belt 41 having a JIS-A hardness of 83 degrees, a width of 5 mm, a length of 325 mm, a thickness of 2 mm, and a dead weight of 4.58 grams. A 100-gram load is hanged at the flat belt 41, and an angle θ at which the load is pulled up (pulling-up angle θ) is set to 40 degrees. In this case, a contact length of the flat belt 41 with respect to the photoconductor 1 in its circumferential direction is 3 mm (=contact area is 15 $mm^2$).

Under the conditions, the load is preferably about 100 grams. If it is light, the contact with the photoconductor 1 becomes uneven. However, if it is heavy, the pressure against the photoconductor 1 increases, the frictional resistance thereby largely varies, and the reliability of measurement is lost. A pulling speed ranges from about 5 mm/s to 15 mm/s, and the JIS-A hardness ranging from 70 to 85 degrees is adequate. If it is 85 degrees or higher, the flat belt 41 lacks in flexibility, an even tight contact of the flat belt 41 with the photoconductor 1 is decreased, and if it is 75 degrees or lower, the load to the photoconductor 1 increases, and therefore, variations in measurements may easily occur.

Figure 15:
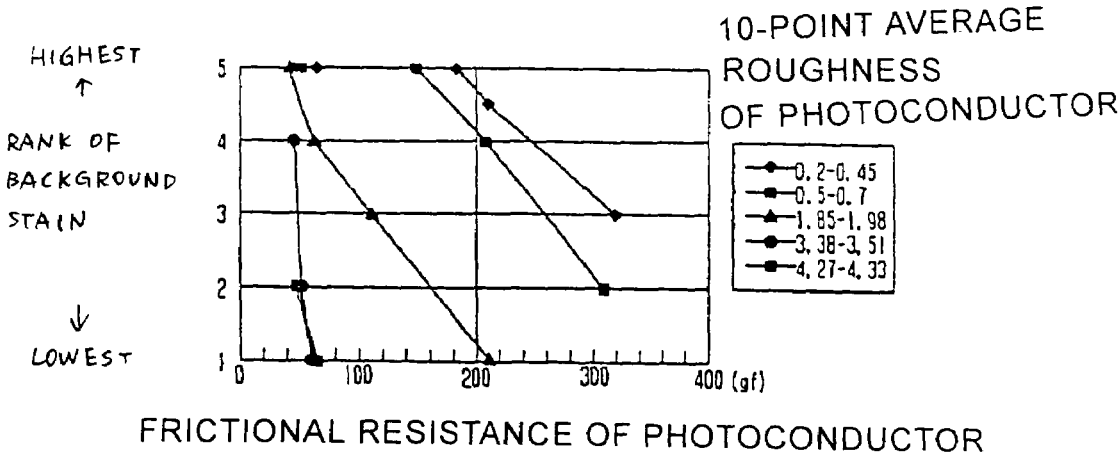
FIG. 15 is a characteristic diagram of cleaning capabilities with respect to frictional resistances using 10-point average roughness on the surface of the photoconductor as parameters.

FIG. 15 is a graph of cleaning capabilities (representing ranks of background stain) with respect to the frictional resistances Rf of the photoconductor 1 using the 10-point average roughness on the surface of the photoconductor 1 as parameters. The toner used is polymer toner (for C1616, weight average particle size: about 6 μm) produced by Fuji Xerox Co., Ltd. The background stain ranks on the y axis indicate that if the number becomes smaller, the cleaning failure more easily occurs. Rank 5 indicates that cleaning capability is most satisfactorily performed with no background stain observed, Rank 4 indicates that spotted background stains slightly appear, and Rank 1 indicates that band-like background stains clearly appear. Any ranks other than Rank 5 cannot stand a practical use.

If the 10-point average roughness of the surface of the photoconductor 1 is lower, the background stain rank is higher, and if the frictional resistance is lower, the background stain rank is higher. For example, if the 10-point average roughness of the photoconductor 1 is 1.0 μm, the frictional resistance Rf may be in a range from 100 gf to 200 gf. If the 10-point average roughness is 0.5 μm or lower, the frictional resistance may be 200 gf or lower. If the frictional resistance decreases, an allowable margin for the cleaning capability increases. However, if it is too low, the blade 10 and the developer slip, and a character image flow occurs. Furthermore, the corona product materials deposited on the photoconductor 1 is difficult to be removed, causing image quality to be degraded. In other words, it is recognized that the lower limit of the frictional resistance Rf is higher than about 45 gf. Therefore, the preferable range of the frictional resistance Rf is 45 gf<Rf<200 gf.

However, the frictional resistance Rf varies depending on measuring conditions. If the temperature is high, the frictional resistance Rf tends to become high. From this fact, the preferable measuring conditions of the frictional resistance Rf are as follows: a temperature ranging from 15° C. to 22° C. and a relative humidity ranging from 55% RH to 65% RH.

The frictional resistance of the photoconductor 1 is one of the main factors that cause the cleaning failure. A frictional-resistance reducing unit for reducing the frictional resistance of the photoconductor 1 is explained below.

The frictional resistance Rf of the surface of the photoconductor 1 is a comparatively low value (150 gf to 350 gf) as its initial value (before image formation). However, the frictional resistance Rf rises each time printing is carried out, and eventually becomes a high value that exceeds 800 gf. If the frictional resistance Rf exceeds 200 gf, the cleaning failure of spherical toner easily occurs. Therefore, it is desirably maintained at 200 gf as the upper limit of the range or below, preferably at 150 gf or below.

Figure 16:
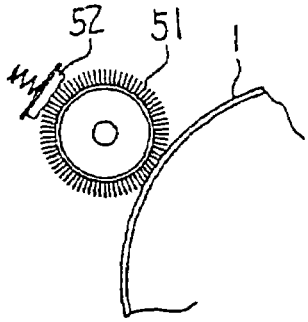
FIG. 16 is a side view of an exemplary lubricant applying unit.
Figure 17:
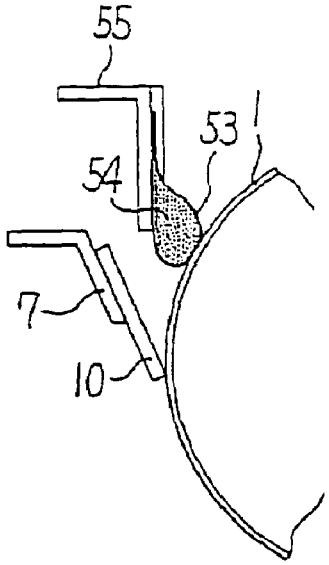
FIG. 17 is a side view of another exemplary lubricant applying unit.

The frictional-resistance reducing unit is most surely realized by using a method of using a lubricant applying unit that applies a lubricant to the surface layer of the photoconductor 1. The lubricant applying unit is realized by using a method of making a lubricant contained over the outermost layer of the photoconductive layer by a thickness of from about 1 μm to about 10 μm (internally adding method), and a method of indirectly applying a lubricant 52 to the surface layer using a rotary brush 51. The lubricant 52 is applied by being pressed by the rotary brush 51 such as a cleaning brush as shown in FIG. 16 and a dedicated brush. Further, as shown in FIG. 17, it is realized by using a method of directly applying a lubricant 53 in powder form (or film form) on the surface layer of the photoconductor 1 using an elastic material 54 (reference numeral 55 represents a lubricant applying member). Alternatively, it is realized by using a method of spraying an air lubricant to the surface of the photoconductor (externally adding method) or a method of adding the lubricant into a developer of the developing device 4. In the embodiment, the lubricant applying unit using any of the methods can be used.

The purpose of adding the lubricant includes reduction of the frictional resistance Rf and maintenance (prevention of degradation) of the surface roughness of the photoconductor 1 and the surface roughness of the edge 10*a* of the blade 10.

Almost all types of lubricants can be used unless they affect degradation in image quality and reduction of durability of the surface layer of the photoconductor 1. Particularly, polytetrafluoroethylene (PTFE) and zinc stearate are effective. This is because a small amount of either one of these is added to cause the frictional resistance Rf to decrease. However, although examples as follows belong to the same fluororesin, the frictional resistance is reduced insufficiently even if any of them is applied to the surface of the photoconductor 1. The examples include polyvinylidene fluoride (PVdF), polytetrafluoroethylene-fluoroalkylvinylether copolymer resin (PFA), and polytetrafluorochloroethylene-ethylene copolymer resin (ETFE). The frictional resistance is generally 200 gf or more. However, they are usable as a material that causes initial rotation of the photoconductor 1.

When the lubricant is applied to the photoconductor 1, non-uniform application is more effective in prevention of abnormal phenomena such as image flow, than uniform application. If a lubricant layer is formed on the surface layer of the photoconductor 1 as continuous film, the frictional resistance becomes too low, corona product materials produced during charging are difficult to be scraped off, and the surface resistivity of the surface of the photoconductor 1 is getting lower and lower, causing image quality to be degraded.

By applying the lubricant non-uniformly or maintaining the lubricant so as to be in a discontinuous state, the continuous film of the corona product materials is discontinued to make the corona product materials to be easily scraped. The lubricant is applied non-uniformly by controlling an addition of lubricant, or setting a contact pressure of the blade 10 to an appropriate value, and adjusting an application unit (not shown). The application unit controls force under which the lubricant touches the brush to apply the lubricant to the photoconductor 1 through the brush, or adds the lubricant to the developer by an appropriate amount to apply it to the photoconductor 1.

The spherical toner used in the embodiment is explained below. The method of manufacturing toner includes mainly a pulverization method and the polymerization method. The highly spherical toner is produced by the polymerization method. The polymerization method includes a suspension polymerization method, a dispersion polymerization method, an emulsion polymerization method, a micro-capsulation polymerization method, and a spray-dry method.

For example, in the case of the suspension polymerization method, the toner is produced by performing uniform treatment on additives such as a colorant and a charge control agent, adding them to binder resin, and adding a dispersion medium or a dispersant thereto to perform polymerization. Since the polymerization method has simplified processes, manufacturing cost is lower than the pulverization method. Furthermore, sizes of toner particles are comparatively identical to one another, and therefore, toner particles having a large size or a small size are selectively produced, and irregular-shaped particles are hardly produced, that is, almost all are spherical toner particles.

Although there are some differences among the polymerization methods, toner particles having particle size with less variations (e.g., ±0.5 μm) are produced as a whole. Accordingly, the particle sizes are almost identical to one another, and therefore, charging is uniformly applied. Consequently, a latent image is developed with fidelity thereto to easily obtain high resolution and high reproducibility of an image.

Because charging characteristics are comparatively identical, transfer efficiency from the photoconductor 1 to the transferred element 9 is 98% or higher, and image quality characteristics are stable. Although toner particles having different sphericities can be produced according to manufacturing conditions of polymer toner, almost spherical toner particles (sphericity ranges from 0.96 to 0.99) are used for a printer (image forming apparatus) because this is advantageous to obtain higher image quality.

The same carrier as that used for toner produced by the pulverization method can be used for the toner produced by the polymerization method. The weight average particle size of the carrier ranges from about 40 μm to about 80 μm, and a ratio of mixing the toner with the carrier is obtained so that the toner is mixed therein by 3 wt % to 8 wt %.

The polymer toner for electrophotography is produced by containing binder resin, a colorant, and a charge control agent as main components and further adding a parting agent thereto.

Ordinary binder resin, colorants, charge control agents, parting agents, and external additives used for the method of manufacturing toner using the polymerization method are exemplified as follows.

(1) Binder Resin

The following conventional materials are used: polymers or copolymers of styrene, ethylene, propylene, butylene, vinyl acetate, vinyl benzoate, methyl acrylate, ethyl acrylate, octyl acrylate, dodecyl acrylate, phenyl acrylate, ethyl methacrylate, methyl methacrylate, butyl methacrylate, vinyl methyl ether, vinyl butyl ether, vinyl methyl ketone, vinyl isopropenyl ketone, vinyl hexyl ketone, vinyl propionate, isobutylene, and chlorostyrene; polystyrene, polyethylene, polyester, styrene-acrylonitrile copolymer, styrene-alkyl methacrylate copolymer, styrene-butadiene copolymer, polypropylene, styrene-maleic anhydride, polyurethane, epoxy resin, and modified rosin.

(2) Colorant

The followings and mixtures thereof can be used: carbon black, Nigrosine dye, ion black, Naphthol Yellow S, Hansa Yellow (10G, 5G, G), cadmium yellow, yellow iron oxide, yellow ocher, chrome yellow, titanium yellow, polyazo yellow, oil yellow, Hansa Yellow (GR, A, RN, R), pigment yellow L, Benzidine Yellow (G, GR), Permanent Yellow (NCG), Vulcan Fast Yellow (5G, R), Tartrazine Lake, Quinoline Yellow Lake, Anthrazane Yellow BGL, Isoindolinone Yellow, red ion oxide, minium, red lead, Cadmium Red, Cadmium Mercury Red, Antimony Vermilion, Permanent Red 4R, Para Red, Fire Red, parachloro-ortho-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, Polyazo Red, Chrome Vermilion, Benzidine Orange, Perinone Orange, Oil Orange, Cobalt Blue, Cerulean Blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), indigo, ultramarine blue, Prussian blue, Anthraquinone Blue, Fast Violet B, Methyl Violet Lake, Cobalt Violet, Manganese Violet, Dioxane Violet, Anthraquinone Violet, Chrome Green, Zinc Green, chrome oxide, pyridian, Emerald Green, Pigment Green B, Naphthol Green B, Green Gold, Acid Green Lake, Malachite Green Lake, Phthalocyanine Green, Anthraquinone Green, titania, zinc white, and lithopone. The content of the colorant is generally from 1 wt % to 15 wt %, preferably from 3 wt % to 10 wt % in the toner.

A parting agent (wax) with a toner binder and a colorant may be contained in the toner of the present invention. Known waxes can be used for the wax. Examples of the wax include polyolefin wax (polyethylene wax, polypropylene wax); long chain hydrocarbon (paraffin wax, Sasol wax, and the like); and carbonyl-group-containing wax. Among these, the carbonyl-group-containing wax is preferable.

The carbonyl-group-containing wax includes polyalkanoic acid ester (carnauba wax, Montan wax, trimethylol propane tribehenate, pentaerythritol tetrabehenate, pentaerythritol diacetate dibehenate, glycerin tribehenate, 1,18-octadecane diol distearate, and the like); polyalkanol ester (trimellitic acid tristearyl, distearyl maleate, and the like); polyalkanoic acid amide (ethylene diamine dibehenyl amide and the like); polyalkyl amide (trimellitic acid tristearyl amide and the like); and dialkyl ketone (distearyl ketone and the like). Among these carbonyl-group-containing waxes, the polyalkanoic acid ester is preferable.

The waxes usually have melting points of from 40° C. to 160° C., preferably from 50° C. to 120° C., and more preferably from 60° C. to 90° C. The wax with a melting point below 40° C. badly affects the heat resistive preservation. The wax with a melting point above 160° C. tends to cause a cold offset at the time of fusing at a low temperature. Preferably, the wax has a melt viscosity of from 5 to 1000 centipoises per sec (cps), more preferably from 10 cps to 100 cps, as a measured value at a temperature higher than the melting point by 20° C. If a wax has a melt viscosity above 1000 cps, the wax has a poor effect in improving the anti-hot offset and low temperature fusing properties. The content of the wax in the toner is normally from 0 wt % to 40 wt %, preferably from 3 wt % to 30 wt %.

(3) Charge Control Agent

A charge control agent can be contained in the toner of the embodiment. Conventional charge control agents can be used for the charge control agent. Examples of the charge control agent include Nigrosine dyes, triphenylmethane dyes, chromium-containing complex dyes, chelate molybdate pigment, Rhodamine dyes, alkoxy amine, and quaternary ammonium salt (including fluorine modified quaternary ammonium salt), alkylamide, phosphor and compounds thereof, tungsten and compounds thereof, fluorine-based active agents, salicylic acid metal salts, and metal salts of salicylic acid derivatives.

More specific examples of the charge control agents are Bontron 03 as a Nigrosine dye, Bontron P-51 as a quaternary ammonium salt, Bontron S-34 as a metal containing azo dye, E-82 as an oxynaphthoe acid type metal complex, E-84 as a salicylic acid metal complex, E-89 as a phenol type condensate (these are produced by Orient Chemical Industries, Ltd.), TP-302 and TP-415 that are quaternary ammonium salt molybdenum complexes (produced by Hodogaya Chemical Industries, Ltd.), Copy Charge PSY VP2038 that is a quaternary ammonium salt, Copy Blue PR that is a triphenylmethane derivative, Copy Charge NEG VP2036 and Copy Charge NX VP434 that are quaternary ammonium salts (these are produced by Hoechst Co., Ltd.), LRA-901 and LR-147 as a boron complex (produced by Japan Carlit Co., Ltd.), copper phthalocyanine, perylene, quinacridone, azo type pigments, and polymer compounds having a functional group such as a sulfonic acid group, a carboxyl group, and quaternary ammonium salt.

The amount of the charge control agent to be used in the embodiment is determined depending on the type of binder resins, presence/absence of additives to be used, and a method of producing toner including a dispersion method, and therefore, it is not uniquely restricted. However, the charge control agent is used in a range from 0.1 to 10 parts by weight (wt. parts), preferably from 0.2 to 5 wt. parts per 100 wt. parts of the binder resin. If it exceeds 10 wt. parts, the toner is charged too highly, which causes effects of the main charge control agent to be decreased, electrostatic attracting force with a developing roller to be increased, fluidity of the developer to be lowered, and image density to be reduced. These charge control agent and the parting agent can be melted and kneaded with master batch and resin, or may be added to an organic solvent when it is solved or dispersed.

(4) Parting Agent

Conventional materials such as aliphatic carbon hydride, aliphatic metal salt, fatty acid ester group, silicone oil, and various waxes can be used.

The parting agent is added to the toner in a proportion of from 0.1 to 10 wt. parts per 100 wt. parts of fixing resin.

(5) External Additives

The external additives are used for helping fluidity, development, and charging of the colorant-containing toner particles, and inorganic particles are preferably used as the external additives. The primary particle size of the inorganic particles is preferably from 5 μm to 200 μm, more preferably from 5 μm to 500 μm. A specific surface area based on the BET method is preferably from 20 $m^2/g$ to 500 $m^2/g$. A proportion of the inorganic particles to be used is preferably 0.01 wt % to 5 wt %, more preferably from 0.01 wt % to 2.0 wt % of toner. Examples of the inorganic particles include silica, alumina, titanium oxide, barium titanate, magnesium titanate, calcium titanate, strontium titanate, zinc oxide, tin oxide, quartz sand, clay, mica, wollastonite, silious earth, chrome oxide, cerium oxide, red oxide, antimony trioxide, magnesium oxide, zirconium oxide, barium sulfate, barium carbonate, calcium carbonate, silicon carbide, and silicon nitride.

In addition to the examples, polymer particles can be used as the inorganic particles. Examples of the polymer particles include copolymers of polystyrene, ester methacrylate, and ester acrylate obtained through soap-free emulsion polymerization, suspension polymerization, or dispersion polymerization; polycondensation type such as silicone, benzoguanamine, and nylon; and polymer particles made of thermosetting resin.

These external additives are subjected to surface treatment to increase hydrophobicity, which makes it possible to prevent degradation of their flow characteristics and charging characteristics under high humidity. Preferable examples of a surface treatment agent includes a silane coupling agent, a sililating agent, a silane coupling agent containing a fluoroalkyl group, an organic titanate type coupling agent, an aluminum type coupling agent, silicone oil, and modified silicone oil.

A cleaning capability improving agent is used for removing developer remaining on a photoconductor and a primary transfer medium after transfer process. Examples of this agent include fatty acid metal salt such as zinc stearate, calcium stearate, and stearic acid; and polymer particles produced by the soap-free emulsion polymerization such as polymethyl methacrylate particles and polystyrene particles. The polymer particles have comparatively narrow particle-size distribution, and a volume average particle size is preferably from 0.01 μm to 1 μm.

Figure 18:
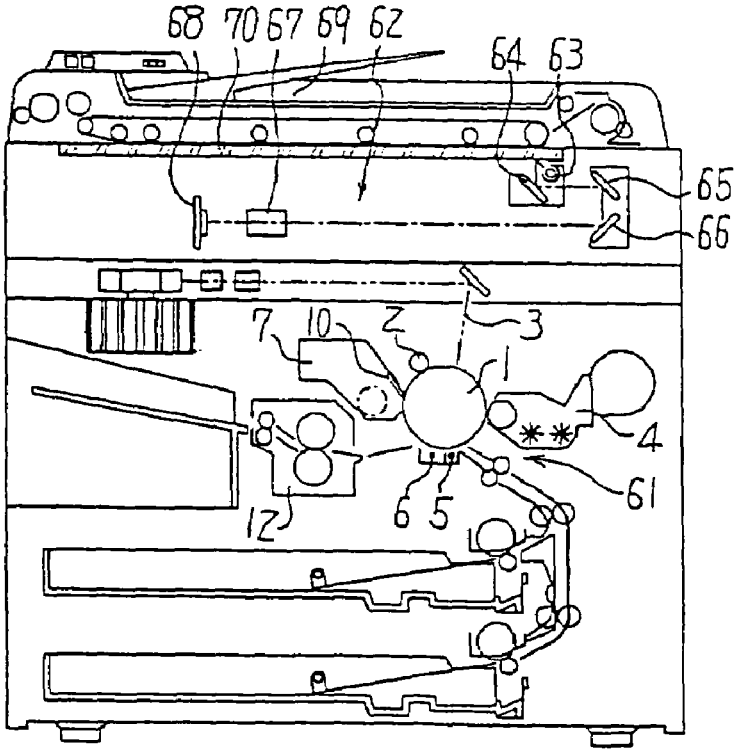
FIG. 18 is a schematic diagram of a copying machine.

Although the examples of applying the present invention to printers have been explained, the printer may be any image forming apparatus that forms images using the electrophotographic process. As shown in FIG. 18, for example, the present invention is also applied to a digital multifunction peripheral (or multifunction peripheral or facsimile) that integrally includes a printer engine 61 with the photoconductor 1 as its core and a scanner 62 for reading a document image. The scanner 62 includes an exposure lamp 63, a plurality of mirrors 64 to 66, an imaging lens 67, and a CCD 68. Reference numeral 69 represents an automatic document feeder (ADF) that automatically feeds the document to a contact glass 70.

The configuration of the printer engine 61 is shown slightly differently from the basic configuration as shown in FIG. 1, but there is no primary difference between the two. Furthermore, the photoconductor 1 and the cleaning device 7 have the same configurations as explained above.

In both the printer and the copying machine, the photoconductor 1 is not only used singly, but also used for full color, so a plurality of photoconductors are provided in this case.

Figure 19:
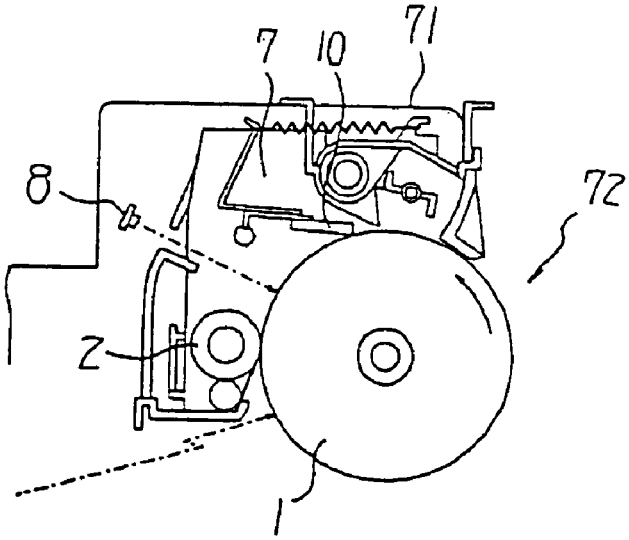
FIG. 19 is a schematic diagram of an exemplary process cartridge.

Furthermore, in both the printer and the copying machine, the present invention can be also applied to the case below. The peripheral configuration around the photoconductor 1 is formed with a process cartridge 72, as shown in FIG. 19, accommodating the photoconductor 1, the charger 2, the cleaning device 7, and the decharger 8 in a cartridge case 71. The process cartridge 72 is then detachably mounted in the printer (or in body of copying machine).

Figure 20:
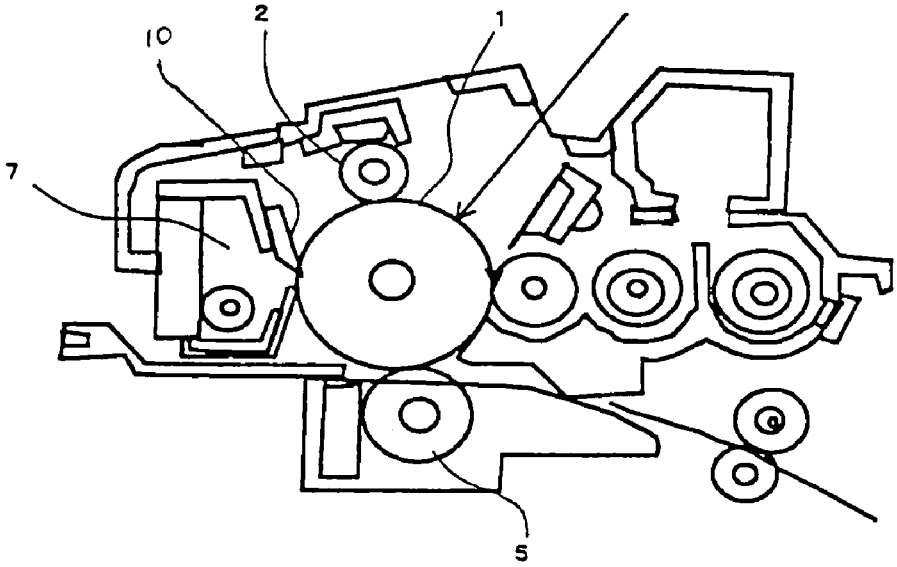
FIG. 20 is a schematic diagram of another exemplary process cartridge.

FIG. 20 is a schematic diagram of the process cartridge including the photoconductor, the charger, the cleaning device, and the developing device. The process cartridge is freely dismounted from the image forming apparatus and so it can be a components that forms the image forming apparatus.

The example of the configuration of the process cartridge 72 is not limited to the above one. Any configuration including the photoconductor 1 and the cleaning device 7 is adequate, and therefore, it may be freely decided whether the cartridge case 71 includes the charger 2, the developing device 4, and the decharger 8.

Forming the process cartridge 72 has an advantage in its maintenance. If some trouble occurs caused by a part of the photoconductor 1 or by the image forming apparatus, it is possible to be restored early to the current state only by replacing the process cartridge 72 with new one. Thus, a service time is reduced to allow reliability of user to obtain, which is greatly advantageous.

EXAMPLES

Materials used for evaluations of Examples 1 to 10 and Comparative Examples 1 to 6 were produced by methods as follows.

A three-layer photoconductor used for evaluation was produced by the method as follows.

A JIS-3003 aluminum alloy drum was processed to have a diameter of 30 mm, a length of 340 mm, and a thickness of 0.75 mm, and was used as a conductive support. The conductive support was dip coated in a coating liquid for an undercoat layer (UL) having the compositions explained below, and was dried at a temperature of 120° C. for 20 minutes to form an undercoat layer having a thickness of 3.5 μm. The undercoat layer was coated with a coating liquid for charge generation layer (CGL) using a following charge generation material, and was thermally dried at a temperature of 120° C. for 20 minutes to form a charge generation layer having a thickness of 0.2 μm. Further, the charge generation layer was dip coated in a coating liquid for a charge transport layer (CTL) using charge transport materials described in Formula 1, pulling-up speed conditions were changed to coat the charge generation layer with the charge transport layer, and the charge transport layer was thermally dried at a temperature of 130° C. for 20 minutes to produce an organic photoconductor having an average thickness of 28 μm.

The average thickness of the photoconductive layer was obtained by measuring 13 points spaced every 20 mm based on a point 50 mm apart from the end of the photoconductor as a start point, using an eddy current film thickness gage (Type mms) produced by Fisher K.K. and by averaging the measured values. All "Part(s)" described below represents a part or parts by weight.

Coating Liquid for Undercoat Layer:

| | |
|---|---|
| Alkyd resin (Beckozol 1307-60-EL, produced by Dainippon Ink & Chemicals, Inc.) | 6 parts |
| Melamine resin (Super Beckamine G-821-60, produced by Dainippon Ink & Chemicals, Inc.) | 4 parts |
| Titanium oxide (CR-EL, produced by Ishihara Sangyo Kaisha, Ltd.) | 40 parts |
| Methyl ethyl ketone | 200 parts |

Coating Liquid for Charge Generation Layer:

| | |
|---|---|
| Oxotitanium phthalocyanine pigment | 2 parts |
| Polyvinyl butyral (UCC: XYHL) | 0.2 part |
| Tetrahydrofuran | 50 parts |

Coating Liquid for Charge Transport Layer:

| | |
|---|---|
| Bisphenol Z-type polycarbonate (Z Polyka, Mv 50000, produced by Teijin Chemicals Ltd.) | 10 parts |
| Low-molecular charge transport substance expressed by the following formula | 8 parts |
| Tetrahydrofuran | 200 parts |

Formula 1

-continued

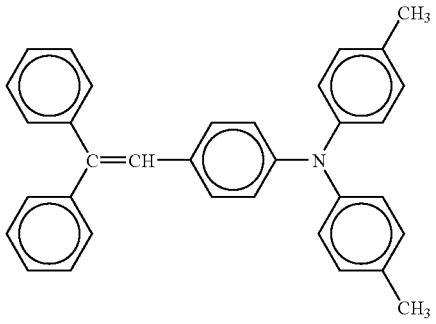

Examples 1, 2, and 3

Imagio MF2200 including a process cartridge produced by Ricoh Co., Ltd. was prepared as an image forming apparatus for evaluation. A three-layer photoconductor having a diameter of 30 mm was prepared. Powder of PTFE (Lubron L-2, produced by Daikin Industries, Ltd.) was previously applied to non-woven fabric, and the surface of the photoconductor was slightly rubbed with the non-woven fabric along the longitudinal direction to cause frictional resistance to be reduced. The photoconductor prepared in such a manner was mounted in each of three process cartridges.

A developing device forming the process cartridge was charged with developer as follows. The developer was obtained by adding 0.7% of $SiO_2$ and 0.8% of $TiO_2$ as a flow agent into pulverized toner having a weight average particle size of about 4.8 μm and an average sphericity of 0.924, and adding zinc stearate (SZ2000) having a weight average particle size of 0.3 μm by 0.04% as Example 1, by 0.03% as Example 2, and by 0.02% as Example 3, respectively. Carrier for the developer was magnetic carrier (FPC-300LC) having a weight average particle size of 63 μm. Zinc stearate is a conditioner for reducing the frictional resistance between the photoconductor and a cleaning blade.

Polyurethane rubber as follows was used for the cleaning blade (blade). The polyurethane rubber had a JIS-A hardness of 77 degrees, a thickness of 2 mm, a length of 320 mm, and a free length from the support to an edge of 8 mm. The edge of the blade was coated with powder of polyvinylidene fluoride. The contact pressure of the blade was adjusted to 25 g/cm.

The process cartridge was mounted in the image forming apparatus, and a running test was conducted by making 50,000 sheets, as the A4-size paper, pass through it under such environments as temperature ranging 22° C. to 25° C. and relative humidity ranging from 56% RH to 62% RH. After the running test, image quality with cleaning performance, especially toner stains on the background of the sheets were evaluated. A position for evaluation was determined as a central part of the photoconductor having a width of 50 mm because the blade edge and the surface roughness of the photoconductor required observation.

Surfcom 1400D (Pickup: E-DT-SO2A), produced by Tokyo Seimitsu Co., Ltd was used for a measuring device of surface roughness. The valley depth Rv of the blade edge was measured by using the ultra-depth profile measuring microscope VK8500 produced by Kience Corp. The width of the central part was set to 50 mm as the position for observation.

The results of the surface roughness expressed by the 10-point average roughness RzJIS and the maximum height Rz, the frictional resistance Rf, and the valley depth (chipped part) Rv of the blade before and after the running test are given in Table 1.

As the results of evaluation in the three examples, each surface roughness was at a low level indicating "not much changed", at which cleaning failure hardly occurred. On the other hand, the frictional resistance increased up to about 138 gf after 50,000 sheets were continuously copied in Example 3, but distortion of the blade and the stick-slip phenomenon did not occur, micro toner particles were cleaned off almost perfectly, that is, there was no problem on cleaning capability. As a result, any background stain was not observed on copied sheets. The image quality was satisfactory, and image quality with good contrast was reproduced.

An applied state of the lubricant was checked. As shown in Photograph 1, variable densities were observed in F (fluorine) atoms, and so it was clearly observed that the lubricant was unevenly applied.

Images were formed by using samples as the photoconductors of Examples 1 and 2 used for evaluation. The photoconductors were left for four hours for dark adaptation under the environments of a temperature of 28° C. and a relative humidity of 90% RH. The resolutions were 5.6 to 7.1 (line/mm) vertically and horizontally, respectively, that is a good result for practical use.

TABLE 1

| EXAMPLE | ITEM | SYMBOL | INITIAL STAGE | AFTER 50000 SHEETS | EVALUATION |
|---|---|---|---|---|---|
| EXAMPLE 1 | SURFACE ROUGHNESS | RzJIS | 0.197 | 0.283 | CLEANING CAPABILITY: VERY GOOD |
| | | Rz | 0.300 | 0.421 | |
| | FRICTIONAL RESISTANCE | Rf | 46 | 62 | |
| | VALLEY DEPTH OF BLADE | Rv | 3.6 | 14.8 | |
| EXAMPLE 2 | SURFACE ROUGHNESS | RzJIS | 0.210 | 0.325 | CLEANING CAPABILITY: VERY GOOD |
| | | Rz | 0.285 | 0.412 | |
| | FRICTIONAL RESISTANCE | Rf | 51 | 85 | |
| | VALLEY DEPTH OF BLADE | Rv | 5.2 | 18.5 | |

TABLE 1-continued

| EXAMPLE | ITEM | SYMBOL | INITIAL STAGE | AFTER 50000 SHEETS | EVALUATION |
|---|---|---|---|---|---|
| EXAMPLE 3 | SURFACE ROUGHNESS | RzJIS | 0.198 | 0.326 | CLEANING CAPABILITY: VERY GOOD |
| | | Rz | 0.279 | 0.492 | |
| | FRICTIONAL RESISTANCE | Rf | 49 | 138 | |
| | VALLEY DEPTH OF BLADE | Rv | 4.8 | 19.3 | |

Examples 4, 5, and 6

The three-layer photoconductor having a diameter of 30 mm produced according to the above specifications was prepared. The PTFE powder was previously applied to non-woven fabric, and the surface of the photoconductor was slightly rubbed with the non-woven fabric along the longitudinal direction to cause frictional resistance to be reduced. The photoconductor prepared in such a manner was mounted in each of three process cartridges.

Only toner to be put into the process cartridges was replaced with polymer toner (sample) produced by Ricoh Co., Ltd. using the suspension polymerization method. The polymer toner had an average sphericity of 0.986 and a weight average particle size of 6.2 μm. The photoconductor having the same configuration as those described in Examples 1, 2, and 3 was used to perform evaluation. The addition of the toner was 5 wt %.

The polymer toner having high average sphericity was used, and the level of the frictional resistance between the photoconductor and the blade was changed to those in Example 4, Example 5, and Example 6 to evaluate cleaning capability of residual powder. The results are compiled in Table 2.

If the toner is highly spherical, an allowable range for the frictional resistance is lower than pulverized toner having a low sphericity. However, when the frictional resistance became as high as 116 gf in Example 6, detailed examination was conducted. As a result, it was observed that there were micro streak patterns. The reason was that the blade was distorted to cause a slight space to be formed between the photoconductor and the blade, although the level of the surface roughness was not particularly a problem. However, it was determined that this level would not cause any practical trouble. No problem was found under conditions other than the above condition.

It was assured that even highly spherical toner could satisfactorily be cleaned off by setting the surface roughness and the frictional resistance to low.

TABLE 2

| EXAMPLE | ITEM | SYMBOL | INITIAL STAGE | AFTER 50000 SHEETS | EVALUATION |
|---|---|---|---|---|---|
| EXAMPLE 4 | SURFACE ROUGHNESS | RzJIS | 0.186 | 0.326 | CLEANING CAPABILITY: VERY GOOD |
| | | Rz | 0.278 | 0.51 | |
| | FRICTIONAL RESISTANCE | Rf | 51 | 75 | |
| | VALLEY DEPTH OF BLADE | Rv | 2.8 | 12.5 | |
| EXAMPLE 5 | SURFACE ROUGHNESS | RzJIS | 0.187 | 0.385 | CLEANING CAPABILITY: VERY GOOD |
| | | Rz | 0.32 | 0.62 | |
| | FRICTIONAL RESISTANCE | Rf | 52 | 81 | |
| | VALLEY DEPTH OF BLADE | Rv | 2.8 | 25.2 | |
| EXAMPLE 6 | SURFACE ROUGHNESS | RzJIS | 0.210 | 0.49 | PRACTICALLY NO PROBLEM, BUT MICRO STREAK STAINS WERE OBSERVED |
| | | Rz | 0.279 | 0.58 | |
| | FRICTIONAL RESISTANCE | Rf | 55 | 116 | |
| | VALLEY DEPTH OF BLADE | Rv | 3.2 | 31.2 | |

Comparative Examples 1 and 2

A three-layer photoconductor having a diameter of 30 mm was prepared. The PTFE powder was previously applied to non-woven fabric, and the surface of the photoconductor was slightly rubbed with the non-woven fabric along the longitudinal direction to cause frictional resistance to be reduced. The photoconductor prepared in such a manner was mounted in each of process cartridges.

Developer produced as follows was put to the process cartridges. The developer was produced by adding zinc stearate as follows to polymer toner (sample) produced by Ricoh Co., Ltd. in the suspension polymerization method.

More specifically, the polymer toner had an average sphericity of 0.986 and a weight average particle size of 6.2 μm. The zinc stearate (SZ2000) having a weight average particle size of 0.3 μm was added to the polymer toner by 0.01% as Comparative Example 1 and by 0.015% as Comparative Example 2. Carrier for the developer was magnetic carrier (BR-021) having a weight average particle size of 58 μm.

Polyurethane rubber as follows was used for the cleaning blade (blade). The polyurethane rubber had a JIS-A hardness of 77 degrees, a thickness of 2 mm, a length of 320 mm, and a free length from the support to an edge of 8 mm. The edge of the blade was coated with powder of polyvinylidene fluoride. The contact pressure of the blade was adjusted to 25g/cm.

The evaluation method was the same as that in Example 1 to Example 6. The results are compiled in Table 3.

As a result of reducing the amount of the lubricant to be input to the toner and reducing the frictional resistance, the surface roughness did not reach the level at which cleaning failure would occur, but the frictional resistance largely increased.

Consequently, the cleaning failure occurred at about 30-th sheet from the start. The possible reason was distortion of the blade edge. Many black bands appeared each time a sheet was copied, and light toner stain appeared over copied images.

TABLE 3

| EXAMPLE | ITEM | SYMBOL | INITIAL STAGE | AFTER 50000 SHEETS | EVALUATION |
|---|---|---|---|---|---|
| COMPARATIVE EX. 1 | SURFACE ROUGHNESS | RzJIS | 0.213 | 0.46 | STAINS OVER WHOLE SURFACE |
| | | Rz | 0.332 | 0.53 | |
| | FRICTIONAL RESISTANCE | Rf | 53 | 564 | |
| | VALLEY DEPTH OF BLADE | Rv | 3.5 | 22.3 | |
| COMPARATIVE EX. 2 | SURFACE ROUGHNESS | RzJIS | 0.234 | 0.354 | STAINS OVER WHOLE SURFACE |
| | | Rz | 0.33 | 0.46 | |
| | FRICTIONAL RESISTANCE | Rf | 56 | 475 | |
| | VALLEY DEPTH OF BLADE | Rv | 2.6 | 19.8 | |

Examples 7 and 8

A three-layer photoconductor having a diameter of 30 mm was prepared. The PTFE powder was previously applied to non-woven fabric, and the surface of the photoconductor was slightly rubbed with the non-woven fabric along the longitudinal direction to cause frictional resistance to be reduced. The photoconductor prepared in such a manner was mounted in each of process cartridges.

The developing device forming the process cartridge was charged with developer as follows. The developer was obtained by adding 0.7% of $SiO_2$ and 0.8% of $TiO_2$ as a flow agent into pulverized toner having a weight average particle size of about 4.8 μm and an average sphericity of 0.924, and adding 0.03% of zinc stearate (SZ2000) having a weight average particle size of 0.3 μm. Carrier for the developer was magnetic carrier (FPC-300LC) having a weight average particle size of 63 μm.

Polyurethane rubber as follows was used for the member of the blade. The polyurethane rubber had a JIS-A hardness of 77 degrees, a thickness of 2 mm, and a length of 320 mm. The polyurethane rubber thus made was bonded to an iron metal support with a hot melt adhesive. The iron metal support was subjected to chrome plating with a thickness of 1 mm so that a contact pressure (linear pressure) between the photoconductor and the blade was set to 10 g/cm as Example 7 and 20 g/cm as Example 8. The edge of the blade was coated with powder of polyvinylidene fluoride, it was thereby prevented to cause distortion in the blade such as twisting or curling when rotation was started. The results are compiled in Table 4.

By setting the contact pressure of the blade to low, both the surface roughness and the frictional resistance were not changed much and were suppressed to the satisfactory level. Even if the contact pressure of the blade was set to 10 g/cm and 20 g/cm that were lower than those in the examples, the level of the background stain was ranked to 5 to 4.5 level, which are sufficient results even by referring to FIG. 13 and FIG. 14. In the case where the contact pressure was 10 g/cm, the level was Rank 5 and there was no particular problem in practical use, but a position apart from the position for evaluation was ranked as Rank 4.5, and a streak pattern was slightly observed at this position. Therefore, it is not appropriate to set the contact pressure to 10 g/cm or less. On the other hand, if it was 20 g/cm, there was no problem in the cleaning capability and image quality with good contrast was obtained.

TABLE 4

| EXAMPLE | ITEM | SYMBOL | INITIAL STAGE | AFTER 50000 SHEETS | EVALUATION |
|---|---|---|---|---|---|
| EXAMPLE 7 | SURFACE ROUGHNESS | RzJIS | 0.223 | 0.325 | CLEANING CAPABILITY: VERY GOOD |
| | | Rz | 0.312 | 0.48 | |
| | FRICTIONAL | Rf | 55 | 80 | |

TABLE 4-continued

| EXAMPLE | ITEM | SYMBOL | INITIAL STAGE | AFTER 50000 SHEETS | EVALUATION |
|---|---|---|---|---|---|
| | RESISTANCE VALLEY DEPTH OF BLADE | Rv | 3.5 | 9.8 | |
| EXAMPLE 8 | SURFACE ROUGHNESS | RzJIS | 0.198 | 0.374 | CLEANING CAPABILITY: VERY GOOD |
| | | Rz | 0.289 | 0.432 | |
| | FRICTIONAL RESISTANCE | Rf | 48 | 75 | |
| | VALLEY DEPTH OF BLADE | Rv | 2.8 | 18.3 | |

Comparative Examples 3 and 4

A three-layer photoconductor having a diameter of 30 mm was prepared. The PTFE powder was previously applied to non-woven fabric, and the surface of the photoconductor was slightly rubbed with the non-woven fabric along the longitudinal direction to cause frictional resistance to be reduced. The photoconductor prepared in such a manner was mounted in each of process cartridges.

The developing device forming the process cartridge was charged with developer as follows. The developer was obtained by adding 0.7% of $SiO_2$ and 0.8% of $TiO_2$ as a flow agent into pulverized toner having a weight average particle size of about 4.8 μm and an average sphericity of 0.924, and adding 0.03% of zinc stearate (SZ2000) having a weight average particle size of 0.3 μm. Carrier for the developer was magnetic carrier (FPC-300LC) having a weight average particle size of 63 μm.

Polyurethane rubber as follows was used for the member of the blade. The polyurethane rubber had a JIS-A hardness of 77 degrees, a thickness of 2 mm, and a length of 320 mm. The polyurethane rubber thus made was bonded to an iron metal support with a hot melt adhesive. The iron metal support was subjected to chrome plating with a thickness of 1 mm so that a contact pressure (linear pressure) between the photoconductor and the blade was set to 45 g/cm as Example 3 and 70 g/cm as Example 4. The edge of the blade was coated with powder of polyvinylidene fluoride, it was thereby prevented to cause distortion in the blade such as twisting or curling when rotation was started. The results are compiled in Table 5.

If the contact pressure of the blade increased, the effects of adding the zinc stearate were decreased, a scraped portion was visible, and the surface roughness was about 3 μm, largely worsened caused by twist of the blade edge. Consequently, the amount of micro toner particles to pass through under the blade increased, and the cleaning failure occurred at both the contact pressure of 45 g/cm and 70 g/cm.

TABLE 5

| EXAMPLE | ITEM | SYMBOL | INITIAL STAGE | AFTER 50000 SHEETS | EVALUATION |
|---|---|---|---|---|---|
| COMPARATIVE EX. 3 | SURFACE ROUGHNESS | RzJIS | 0.198 | 1.98 | STREAK-LIKE STAINS OVER WHOLE SURFACE |
| | | Rz | 0.288 | 2.69 | |
| | FRICTIONAL RESISTANCE | Rf | 56 | 340 | |
| | VALLEY DEPTH OF BLADE | Rv | 3.6 | 34.8 | |
| COMPARATIVE EX. 4 | SURFACE ROUGHNESS | RzJIS | 0.158 | 2.76 | STREAK-LIKE STAINS OVER WHOLE SURFACE |
| | | Rz | 0.23 | 3.21 | |
| | FRICTIONAL RESISTANCE | Rf | 49 | 870 | |
| | VALLEY DEPTH OF BLADE | Rv | 2.6 | 57.2 | |

Examples 9 and 10

A three-layer photoconductor having a diameter of 30 mm was prepared. The PTFE powder was previously applied to non-woven fabric, and the surface of the photoconductor was slightly rubbed with the non-woven fabric along the longitudinal direction to cause frictional resistance to be reduced. The photoconductor prepared in such a manner was mounted in each of process cartridges.

Developer produced as follows was put to the process cartridges. The developer was produced by adding zinc stearate as follows to polymer toner (sample) produced by Ricoh Co., Ltd. in the suspension polymerization method. More specifically, the polymer toner had an average sphericity of 0.986 and a weight average particle size of 6.2 μm. The zinc stearate (SZ2000) having a weight average particle size of 0.3 μm was added to the polymer toner by 0.01% as Comparative Example 1 and by 0.015% as Comparative Example 2. Carrier for the developer was magnetic carrier (BR-021) having a weight average particle size of 58 μm.

Polyurethane rubber as follows was used for the cleaning blade (blade). The polyurethane rubber had a JIS-A hardness of 77 degrees, a thickness of 2 mm, a length of 320 mm, and a free length from the support to an edge of 8 mm. The edge of the blade was coated with powder of polyvinylidene fluoride. The contact pressure of the blade was adjusted to 25g/cm.

As for the blade used for checking, however, the blade as follows was used for evaluation. This blade was once used and so the valley depth Rv of the blade edge became larger. The maximum valley depth Rv over the central width of 100 mm of the blade was 18.4 μm in Example 9, and 24.7 μm in Example 10. Further, a range of the measured valley depth was from 6.3 to 18 μm in Example 9, and was from 8.2 μm to 24.7 μm in Example 10.

The results of evaluating influence of the maximum depth of the blade edge are given in Table 6.

The surface roughness and the frictional resistance were normal even after the running test, and this is an allowable level. Even when the maximum valley depth of the blade edge became 42 μm in Example 10 after the running test, no space was produced at the portion of the valley, and substantially satisfactory cleaning capability was obtained. However, the position was different from the position where the initial measurement was conducted, and a few streak patterns with spots were observed although they were vague. When the maximum valley depth of the blade edge was less than the value, sufficient cleaning capability, particularly, no background stain on copied sheets was observed.

Because the blade was once used, the blade edge might be brittle, or foreign matters such as carrier might be contaminated.

TABLE 6

| EXAMPLE | ITEM | SYMBOL | INITIAL STAGE | AFTER 50000 SHEETS | EVALUATION |
|---|---|---|---|---|---|
| EXAMPLE 9 | SURFACE ROUGHNESS | RzJIS | 0.158 | 0.287 | CLEANING CAPABILITY: VERY GOOD |
| | | Rz | 0.298 | 0.331 | |
| | FRICTIONAL RESISTANCE | Rf | 47 | 78 | |
| | VALLEY DEPTH OF BLADE | Rv | 18 | 29 | |
| EXAMPLE 10 | SURFACE ROUGHNESS | RzJIS | 0.214 | 0.312 | CLEANING CAPABILITY: VERY GOOD, NO PARTICULAR PROBLEM WAS OBSERVED |
| | | Rz | 0.33 | 0.389 | |
| | FRICTIONAL RESISTANCE | Rf | 51 | 101 | |
| | VALLEY DEPTH OF BLADE | Rv | 24 | 42 | |

Comparative Examples 5 and 6

The three-layer photoconductor (photoconductor) having a diameter of 30 mm produced according to the specification for the photoconductor was prepared. Two pieces of the photoconductors were produced and used once, and then foreign matters such as toner adhered to the surface of the photoconductor were removed therefrom. The PTFE powder was previously applied to non-woven fabric, and the surface of the photoconductor was slightly rubbed with the non-woven fabric along the longitudinal direction to cause frictional resistance to be reduced. The photoconductor was mounted in the process cartridge.

Developer produced as follows was put to the process cartridges. The developer was produced by adding zinc stearate as follows to polymer toner (sample) produced by Ricoh Co., Ltd. in the suspension polymerization method. More specifically, the polymer toner had an average sphericity of 0.986 and a weight average particle size of 6.2 μm. The zinc stearate (SZ2000) having a weight average particle size of 0.3 μm was added to the polymer toner by 0.01% as Comparative Example 1 and by 0.015% as Comparative Example 2. Carrier for the developer was magnetic carrier (BR-021) having a weight average particle size of 58 μm.

Polyurethane rubber as follows was used for the cleaning blade (blade). The polyurethane rubber had a JIS-A hardness of 77 degrees, a thickness of 2 mm, a length of 320 mm, and a free length from the support to an edge of 8 mm. The edge of the blade was coated with powder of polyvinylidene fluoride. The contact pressure of the blade was adjusted to 25 g/cm.

It is noted that the blade was replaced with respective blades used for about 250,000 sheets, one of the blades whose maximum valley depth was 45 μm in Comparative Example 5 and the other whose maximum valley depth was 78 μm in Comparative Example 6. The respective blades were used to evaluate the effects of the maximum valley depths. The results are compiled in Table 7.

The frictional resistance was not reduced to a sufficiently low level as in the Examples because the surface of the photoconductor had many scratches, but the frictional resistance was normal, that is it was not at the level at which cleaning failure would occur. However., since the surface had a high surface roughness and the blade had a great valley depth, toner cannot be blocked, and cleaning failure thereby occurred. The cleaning failure started from some initial sheets, and many black streak-like background stains were observed on copied sheets. Therefore, the evaluation was terminated at the 100-th sheet.

TABLE 7

| EXAMPLE | ITEM | SYMBOL | INITIAL STAGE | AFTER 50000 SHEETS | EVALUATION |
|---|---|---|---|---|---|
| COMPARATIVE EX. 5 | SURFACE ROUGHNESS | RzJIS | 1.23 | 1.45 | STREAK-LIKE STAIN |
| | | Rz | 2.260 | 2.52 | |
| | FRICTIONAL RESISTANCE | Rf | 82 | 125 | |
| | VALLEY DEPTH OF BLADE | Rv | 45 | 67 | |
| COMPARATIVE EX. 6 | SURFACE ROUGHNESS | RzJIS | 1.678 | 1.725 | STREAK-LIKE STAIN |
| | | Rz | 2.78 | 2.88 | |
| | FRICTIONAL RESISTANCE | Rf | 114 | 178 | |
| | VALLEY DEPTH OF BLADE | Rv | 78 | 84 | |

Materials for use in evaluation of Examples 11 to 23 and Comparative Examples 7 to 12 were produced in the following methods.

Organic Photoconductor:

(1) Type A Organic Photoconductor

A JIS-3003 aluminum alloy drum was processed to have a diameter of 30 mm, a length of 340 mm, and a thickness of 0.75 mm, and was used as a conductive support. The conductive support was dip coated in a coating liquid for an undercoat layer (UL) having the following specifications, and was dried at a temperature of 120° C. for 20 minutes to form an undercoat layer having a thickness of about 3.5 μm. The undercoat layer was dip coated by a coating liquid for charge generation layer (CGL) using a charge generation material described in Formula 1, and was thermally dried at a temperature of 120° C. for 20 minutes to form a charge generation layer having a thickness of 0.2 μm. Further, the charge generation layer was dip coated in a coating liquid for a charge transport layer (CTL) using a charge transport material described in Formula 2, pulling-up speed conditions were changed to coat the charge generation layer with respective charge transport layers, and the charge transport layers were thermally dried at a temperature of 130° C. for 20 minutes to produce four types of organic photoconductors having average thicknesses of 15 μm, 23 μm, 28 μm, and 35 μm, respectively. The three-layer organic photoconductors are referred to as Type A organic photoconductor.

The average thickness of the photoconductive layer was obtained by measuring 13 points spaced every 20 mm based on a point 50 mm apart from the end of the photoconductor as a start point, using an eddy current film thickness gage (Type mms) produced by Fisher K.K. and by averaging the measured values. All "Part(s)" described below represents a part or parts by weight.

Coating Liquid for Undercoat Layer:

| | |
|---|---|
| Alkyd resin (Beckozol 1307-60-EL, produced by Dainippon Ink & Chemicals, Inc.) | 6 parts |
| Melamine resin (Super Beckamine G-821-60, produced by Dainippon Ink & Chemicals, Inc.) | 4 parts |
| Titanium oxide (CR-EL, produced by Ishihara Sangyo Kaisha, Ltd.) | 40 parts |
| Methyl ethyl ketone | 200 parts |

Coating Liquid B for Charge Generation Layer:

Bisazo pigment expressed by the following formula 10 parts

Formula 2

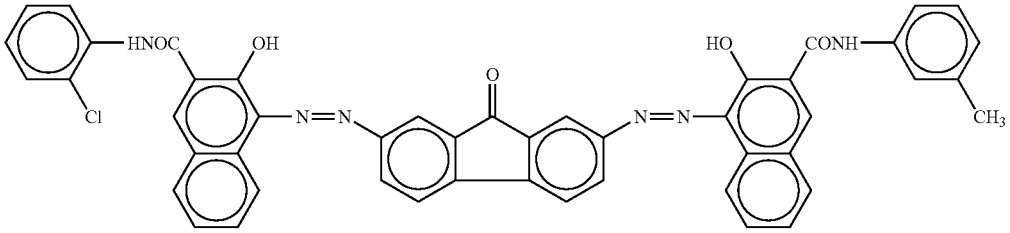

| | |
|---|---|
| Polyvinyl butyral | 2 parts |
| 2-butanone | 200 parts |
| Cyclohexanone | 400 parts |

Coating Liquid for Charge Transport Layer:

| | |
|---|---|
| Bisphenol Z-type polycarbonate (Z Polyka, Mv 50000, produced by Teijin Chemicals Ltd.) | 10 parts |
| Low-molecular charge transport substance expressed by the following formula<br>Formula 3 | 8 parts |
| Tetrahydrofuran | 200 parts |

An organic photoconductor was produced by laminating a charge transport layer (filler-dispersed charge transport layer), in which α alumina filler according to the specifications below was dispersed, on the charge transport layers (CTL) of the type A organic photoconductors having thicknesses of 15 μm and 23 μm, respectively.

Binder resin (Bisphenol Z-type polycarbonate resin), a low-molecular charge transport substance (donor), additives, and an inorganic filler having a primary particle size of 0.3 μm were prepared. The inorganic filler, a dispersion assistant, and a solution were put into a glass pot, and dispersed by a ball mill for 24 hours to prepare a coating liquid. The coating liquid was sprayed to and fro a few times to coat the respective type A photoconductors with the filler-dispersed charge transport layer. The filler-dispersed charge transport layer was thermally dried at 150° C. for 20 minutes to produce 20 μm- and 28 μm-organic photoconductors each having the filler-dispersed charge transport layer having a thickness ranging from 3 μm to 5 μm. These four-layer photoconductors are referred to as Type B photoconductor.

Coating Liquid for Filler-Dispersed Charge Transport Layer:

| | |
|---|---|
| Bisphenol Z-type polycarbonate (Z Polyka, Mv 50000, produced by Teijin Chemicals Ltd.) | 10 parts |
| Charge transport substance expressed by the following formula<br>Formula 4 | 7 parts |
| Alumina filler (AA-03 α type, average primary particle size: 0.3 μm, produced by Sumitomo Chemical Co., Ltd.) | 5.7 parts |
| Tetrahydrofuran | 400 parts |
| Cyclohexanone | 200 parts |
| Dispersion assistant (BYK-P104, produced by Bick Chemie Japan Co.) | 0.08 parts |

A list of the produced photoconductors is given in Table 8. It is noted that the surface roughness (10-point average roughness RzJIS) of the organic photoconductors indicates initial values before evaluation, and Surfcom 1400D (Pickup: E-DT-SO2A) produced by Tokyo Seimitsu Co., Ltd. was used for the measuring device. A sweep width was 2.5 mm.

TABLE 8

| PHOTOCONDUCTOR SAMPLE NO. | FILM THICKNESS OF TYPE A ORGANIC PHOTOCONDUCTOR μm | FILLER-CONTAINING CHARGE TRANSPORT LAYER AVERAGE PARTICLE SIZE μm | ADDITION wt % | FILM THICKNESS μm | TOTAL FILM THICKNESS OF CHARGE TRANSPORT LAYER μm |
|---|---|---|---|---|---|
| 1 | 28 | — | — | — | 28 |
| 2 | 35 | — | — | — | 35 |
| 3 | 15 | 0.3 | 20 | 5 | 20 |
| 4 | 23 | 0.3 | 25 | 5 | 28 |
| 5 | 23 | 0.5 | 25 | 5 | 28 |
| 6 | 23 | 0.7 | 20 | 3 | 26 |
| 7 | 23 | 1.0 | 25 | 5 | 28 |

Cleaning Member:

1) Cleaning Blade

Three cleaning blades were obtained as follows. Three polyurethane rubber plates having a JIS-A hardness of 77, 83, and 89 degrees, respectively, and a thickness of 2 mm were prepared, and each of the polyurethane rubber plates was bonded to an ion support base having a thickness of 1 mm with a hot melt adhesive. A length (free length) from the edge of the support base to the edge of the cleaning blade in contact with a photoconductor was 7 mm.

Two types of the cleaning blades were used for Imagio MF2200 and Ipsio Color 8000 as machines for evaluation (both are produced by Ricoh Co., Ltd.).

2) Cleaning Brush (Loop Brush)

Loop cleaning brushes obtained in the following manner were used. Nylon fiber Belltron (produced by Kanebo Ltd.) and acrylic fiber SA-7 (Toray Industries, Inc.) each having a diameter of 15 denier, 48 filaments/450 loop, and a loop length of 3 mm. Each of these fibers was cut to a strip with 10 mm wide, the strip was wound around a brass rod having a diameter of 5 mm to be fixed with an adhesive.

(3) Charging Member (3-1) Charging Member for Contact Charging

A charging member for contact charging was obtained in the following manner. Carbon was uniformly dispersed in a 6-mm brass rod, epichlorohydrin rubber with a prepared electrical resistance of $6\times10^5$ ohm-centimeters (when 100 VDC was applied) was coated on the brass rod so as to have a layer of a thickness of 3 mm and was polished. Another epichlorohydrin rubber was prepared by dispersing carbon, silica, and fluororesin therein so as to have an electrical resistance of (3 to 5)×108 ohm-centimeters (when 100 VDC was applied). This epichlorohydrin rubber was then uniformly coated on the layer with a thickness of 1 mm to produce the charging member with dimensions of ϕ14 mm×314 mm (effective charging width: 312 mm).

(3-2) Charging Member for Non-Contact Charging

A charging member for a non-contact charging was obtained in the following manner. Epichlorohydrin rubber was prepared by dispersing carbon, silica, and fluororesin therein so as to have an electrical resistance of $5.8\times10^5$ ohm-centimeters (when 100 VDC was applied). The epichlorohydrin rubber was then coated on a 8-mm brass rod with a thickness of 1.5 mm to produce the charging member with dimensions of ϕ11 mm×327 mm (effective charging width: 308 mm). Polyethyleneterephthalate (PET) cut into a rhomboid having a thickness of 49 μm, a width of 8 mm, and a length of 31 mm was bonded to the charging member at a place 1.5 mm inward from both ends thereof to serve as a spacer.

Examples 11 to 13

As an image forming apparatus for evaluation, the process cartridge type Imagio MF2200 machine (produced by Ricoh Co., Ltd.) was prepared. As photoconductors for evaluation, the type A organic photoconductor and the type B organic photoconductors were prepared. More specifically, the type A organic photoconductor as sample No. 1 (Example 11) had 10-point average roughness RzJIS of 0.143 μm, and the type B organic photoconductors as sample No. 4 (Example 12) and sample No. 6 (Example 13) had 10-point average roughness RzJIS of 0.433 μm and 0.781 μm, respectively.

In order to prevent locking at initial rotation of the photoconductor, spherical toner to be used as developer was sufficiently coated on both the surface layer of the photoconductor and the edge of the cleaning blade, and the photoconductor and the cleaning blade were mounted in a process cartridge so that the photoconductor was made to rotate easily by hand. Then, the process cartridge including the charging member for contact charging was mounted in the image forming apparatus for evaluation.

Developer for developing an electrostatic latent image obtained by mixing toner with carrier in the following manner was used. The toner was obtained by adding 0.018% of zinc stearate (SZ2000, produced by Sakai Chemical Industry Co., Ltd.), which reduces frictional resistance of the photoconductor, to spherical toner (produced by Ricoh Co., Ltd.) obtained using the emulsion polymerization method to have a weight average particle size of about 6.3 μm and an average sphericity of 0.972. The carrier (produced by Ricoh Co., Ltd.) was coated with silicone resin to have an weight average particle size of about 52 μm. The toner and the carrier were mixed so that the toner density would be 6 wt %.

A member obtained in the following manner was used for the cleaning blade. The member was obtained by fixing a polyurethane blade including a blade edge, which has 10-point average roughness RzJIS of 10 μm or less and JIS-A hardness of 83 degrees, to a support base so as to have a free length of 7 mm. A contact pressure was set to 23 grams.

The method of evaluation was executed by applying a voltage of about −1150 volts to the charging member to check it 10 cycles, setting a set value of a charging potential Vd of the photoconductor to about −650 volts (charging potential before an electrostatic latent image was formed), and adjusting output of a laser disk (LD) device for image exposure so that a potential VI of an image portion after the image exposure was −110 volts. Further, developing bias potential was set to −500 volts. Under such conditions, a running test for making 20,000 sheets (A-4 size paper) to pass through the photoconductor was conducted by using a predetermined 6% test chart. Image formation was evaluated by using an A-3 size evaluation test chart with charts (JIS Z 6008) produced by Kodak Co. adhered to four areas thereof and using A-3 size paper.

The results are compiled in Table 9. The type A organic photoconductor (Example 11) and the type B organic photoconductors of sample No. 4 (Example 12) and sample No. 6 (Example 13) were evaluated after 20,000 sheets were copied. The results were very good as a whole, that is, the cleaning capability was very good with no background stain observed and the surface roughness of both the photoconductor and the blade was observed normal. Although those as follows are not given in Table 9, the amount of abrasion of the photoconductor according to Example 11 after 20,000 sheets was about 3 μm, while the amounts of abrasion of the photoconductors according to Example 12 and Example 13 were about 1.1 μm and 0.8 μm, respectively, and mechanical durability of the photoconductors was observed good.

TABLE 9

| EXAMPLE | 10-POINT AVERAGE ROUGHNESS OF PHOTOCONDUCTOR Rz JIS (μm) INITIAL STAGE | AFTER RUN | FRICTIONAL RESISTANCE Rf (gf) AFTER 200 SHEETS | AFTER RUN | BLADE EDGE SURFACE ROUGHNESS/ MAXIMUM DEPTH OF CHIPPED PART(μm) INITIAL STAGE | AFTER RUN | CLEANING CAPABILITY | RESOLUTION LONGITUDINAL/ LATERAL (LINE/mm) | DETERMINATION |
|---|---|---|---|---|---|---|---|---|---|
| EXAMPLE 11 | 0.143 | 0.293 | 152 | 166 | 10> | 32 | VERY GOOD | 8.0/7.1 | ○ |
| EXAMPLE 12 | 0.433 | 0.612 | 128 | 182 | 10> | 56 | VERY GOOD | 7.1/7.1 | ○ |
| EXAMPLE 13 | 0.781 | 0.899 | 145 | 191 | 10> | 65 | VERY GOOD | 7.1/6.3 | ○ |

The results of determination indicated by symbols in Table 9 to Table 14 are as follows. Circle: No noise was recognized and image quality was very good. Triangle: Spotted line was slightly noticeable after a careful check, and there was observed almost no degradation in resolution, which remains within practical limits. One Cross: Black streak having a width of from about 0.5 to about 2 mm was visible although image quality such as resolution was slightly degraded, but it is beyond the practical limits. Double Cross: Black band of 2 mm or more was clearly visible.

Examples 14 to 17

The type A organic photoconductor of sample No. 1 (Example 14) having 10-point average roughness RzJIS of 0.139 and the type B organic photoconductors: sample No. 3 (Example 15) having 0.361, sample No. 5 (Example 16) having 0.588, and sample No. 7 (Example 17) having 0.878 were used for photoconductors for evaluation. Spherical toner (produced by Ricoh Co., Ltd.) was used. Specifically, the spherical toner was produced in the emulsion polymerization method and had a weight average particle size of about 6.3 μm and average sphericity of 0.972, and was added with 0.025 wt % of zinc stearate. Polyurethane blade having JIS-A hardness of 89 degrees was used for a cleaning blade. Further, all the charging potentials of the photoconductors were set to −550 volts (charging potential before formation of electrostatic latent images) according to the sample No. 3 having a thin film thickness, and a developing bias was set to −450 volts. The conditions other than these were the same as those in Examples 11 to 13

The results are compiled in Table 10. By increasing the addition of zinc stearate in toner, the frictional resistance of the photoconductor lowered, the chipped amount and its depth of the blade edge decreased. Therefore, even if a blade having a high hardness of 89 degrees was used, the photoconductor was less flawed, and a streak-like pattern that might occur when cleaning failure (toner escaping) occurred was not observed on a copied sheet, thus obtaining images excellent in resolution. However, only in the photoconductor of Example 17, the surface roughness of both the photoconductor and the blade edge after the running test increased. Therefore, it still remains within practical limits even after about 20,000 sheets were copied, but cleaning failure was slightly observed.

TABLE 10

| EXAMPLE | 10-POINT AVERAGE ROUGHNESS OF PHOTOCONDUCTOR Rz JIS (μm) INITIAL STAGE | AFTER RUN | FRICTIONAL RESISTANCE Rf (gf) AFTER 200 SHEETS | AFTER RUN | BLADE EDGE SURFACE ROUGHNESS/ MAXIMUM DEPTH OF CHIPPED PART(μm) INITIAL STAGE | AFTER RUN | CLEANING CAPABILITY | RESOLUTION LONGITUDINAL/ LATERAL (LINE/mm) | DETERMINATION |
|---|---|---|---|---|---|---|---|---|---|
| EXAMPLE 14 | 0.139 | 0.221 | 145 | 98 | 10> | 29 | VERY GOOD | 7.1/6.3 | ○ |
| EXAMPLE 15 | 0.361 | 0.512 | 110 | 84 | 10> | 48 | VERY GOOD | 7.1/7.1 | ○ |
| EXAMPLE 16 | 0.588 | 0.878 | 134 | 125 | 10> | 61 | VERY GOOD | 6.3/7.1 | ○ |
| EXAMPLE 17 | 0.878 | 1.094 | 145 | 138 | 10> | 68 | GOOD | 7.1/7.1 | Δ |

Comparative Examples 7 to 9

The type A organic photoconductor of sample No. 1 (Comparative Example 7) the same as that of Example 11 and the type B organic photoconductors: sample No. 4 (Comparative Example 8) and sample No. 6 (Comparative Example 9) were used for photoconductors for evaluation. Spherical toner without zinc stearate was used for toner, and developer obtained by mixing 6 wt % of the toner per carrier was used. Application of the toner in order to smooth initial rotation of the photoconductor and the other conditions were the same as those of Examples 11 to 13, and under such conditions evaluations were conducted.

The results are compiled in Table 11. Because no zinc stearate was added to the developer, the frictional resistance of the photoconductor was not reduced. Therefore, after about 10 initial sheets were copied, slight cleaning failure started to occur. The frictional resistance of the photoconductor was measured after 10 sheets were copied, and the result thereof was about 300 gf, which already exceeded an allowable value. Because of this, sliding between the photoconductor and the blade caused squeaky noise (high frequency sound) to be produced. Evaluation was therefore terminated at the 50-th sheet. Although the flaw on the photoconductor and the surface roughness of the blade increased, the number of sheets to be evaluated was too small to find obvious degradation.

The type B organic photoconductors equivalent to those of sample No. 4 (Examples 18 and 19) and sample No. 5 (Examples 20 and 21) were used for photoconductors for evaluation.

A cleaning brush obtained by using acrylic fiber SA-7 (Toray Industries, Inc.) was used, and the cleaning brush was grounded (Examples 18 and 20) or was applied with an ac voltage of 800 volts/1000 hertz (Examples 19 and 21). The cleaning blade was used for about 5,000 sheets in another experiment, polyurethane rubber having JIS-A hardness of 77 degrees was used, and the contact pressure of the cleaning member was set to 25 g/cm.

Spherical toner (produced by Ricoh Co., Ltd.) having a weight average particle size of 0.523 and average sphericity of 0.988 was used for toner, and 0.025 wt % of zinc stearate (SZ2000, produced by Sakai Chemical Industry Co., Ltd.) as a lubricant was added to the toner.

TABLE 11

| | 10-POINT AVERAGE ROUGHNESS OF PHOTOCONDUCTOR Rz JIS (μm) | | FRICTIONAL RESISTANCE Rf (gf) | | BLADE EDGE SURFACE ROUGHNESS/ MAXIMUM DEPTH OF CHIPPED PART(μm) | | CLEANING | RESOLUTION LONGI-TUDINAL/ | |
|---|---|---|---|---|---|---|---|---|---|
| EXAMPLE | INITIAL STAGE | AFTER RUN | AFTER 10 SHEETS | AFTER 50 SHEETS | INITIAL STAGE | AFTER RUN | CAPA-BILITY | LATERAL (LINE/mm) | DETER-MINATION |
| COMPARATIVE EX. 7 | 0.148 | 0.312 | 280 | 986 | 10> | 43 | FAILURE | 7.1/7.1 | X |
| COMPARATIVE EX. 8 | 0.439 | 0.598 | 320 | 1154 | 10> | 68 | FAILURE | 7.1/8.0 | XX |
| COMPARATIVE EX. 9 | 0.765 | 0.889 | 340 | 1120 | 10> | 89 | FAILURE | 6.3/7.1 | XX |

Examples 18 to 21

The machine for evaluation was replaced with Ipsio Color 8000 (Tandem type copying machine including the cleaning blade and cleaning brush, produced by Ricoh Co., Ltd.) to conduct evaluation tests. A photoconductor was mounted in each of a magenta station and a cyan station, and a dummy photoconductor was mounted in each of another two stations.

A non-contact charging member was used for the charging member for Ipsio Color 8000. A space between the photoconductor and the charging member was from 53 μm to 58 μm. A dc voltage of −680 volts or a dc voltage with an ac voltage of 1500 volts/1350 hertz superposed thereon was applied to the charging member to set the surface potential of the photoconductor to −600 volts (charging potential before formation of electrostatic latent images).

Images were evaluated by inputting signals of images including character images and lines from a PC. Image quality was evaluated not based on resolution but one-dot reproducibility.

The results are compiled in Table 12. Under the conditions of image formation in Examples 18 to 21, the case where the ac voltage was applied to the cleaning brush was worse in the characteristic values of the surface roughness and the frictional resistance than the case where the cleaning brush was grounded. However, even if the spherical toner having average sphericity of 0.988 indicating almost perfect sphericity was used, satisfactory cleaning capability was achieved, that is, a streak-like pattern was not observed. Furthermore, one-dot reproducibility based on 1200 dpi was so good that unevenness was hardly observed.

TABLE 12

| EXAMPLE | VOLTAGE OF CLEANING BRUSH | 10-POINT AVERAGE ROUGHNESS OF PHOTO-CONDUCTOR Rz JIS (μm) INITIAL STAGE | AFTER RUN | FRICTIONAL RESISTANCE Rf (gf) AFTER 200 SHEETS | AFTER RUN | BLADE EDGE SURFACE ROUGHNESS/ MAXIMUM DEPTH OF CHIPPED PART(μm) INITIAL STAGE | AFTER RUN | CLEANING CAPA-BILITY | 1dot REPRO-DUCIBILITY | DETER-MINATION |
|---|---|---|---|---|---|---|---|---|---|---|
| EXAMPLE 18 | GROUNDED | 0.339 | 0.423 | 163 | 112 | 42 | 55 | VERY GOOD | VERY GOOD | ○ |
| EXAMPLE 19 | AC VOLTAGE | 0.385 | 632 | 148 | 134 | 34 | 68 | VERY GOOD | VERY GOOD | ○ |
| EXAMPLE 20 | GROUNDED | 0.547 | 0.683 | 156 | 154 | 49 | 61 | VERY GOOD | VERY GOOD | ○ |
| EXAMPLE 21 | AC VOLTAGE | 0.526 | 0.889 | 158 | 172 | 26 | 67 | VERY GOOD | VERY GOOD | ○ |

Comparative Examples 10 to 12

As an image forming apparatus for evaluation, the process cartridge type Imagio MF2200 machine (produced by Ricoh Co., Ltd.) was prepared. As photoconductors for evaluation, the type A organic photoconductor and the type B organic photoconductors were prepared. More specifically, the type A organic photoconductor as sample No. 1 (Comparative Example 10) had been used once and had 10-point average roughness RzJIS of 0.485 μm, and the type B organic photoconductors as sample No. 4 (Comparative Example 11) and sample No. 6 (Comparative Example 12) had 10-point average roughness RzJIS of 0.98 μm and 0.688 μm, respectively.

The cleaning blade was a member obtained by fixing a polyurethane blade having JIS-A hardness of 77 degrees to a support base so that the free length would be 7 mm. The cleaning blades whose blade edges used for about 2,000 sheets to 5,000 sheets had a surface roughness (depth of chipped part) of 68 μm (Comparative Example 10), 48 μm (Comparative Example 11), and 39 μm (Comparative Example 12), respectively. A contact pressure was set to 23 grams.

In order to prevent locking at initial rotation of the photoconductor, spherical toner to be used as developer was sufficiently coated on both the surface layer of the photoconductor and the edge of the cleaning blade, and the photoconductor and the cleaning blade were mounted in a process cartridge so that the photoconductor was made to rotate easily by hand. Then, the process cartridge including the charging member for contact charging was mounted in the image forming apparatus for evaluation.

Developer for developing an electrostatic latent image obtained by mixing toner with carrier in the following manner was used. The toner was obtained by adding 0.015% of zinc stearate (SZ2000, produced by Sakai Chemical Industry Co., Ltd.), which reduces frictional resistance of the photoconductor, to spherical toner (produced by Ricoh Co., Ltd.) obtained using the emulsion polymerization method to have a weight average particle size of about 6.3 μm and an average sphericity of 0.968. The carrier (produced by Ricoh Co., Ltd.) was coated with silicone resin to have weight average particle size of about 52 μm. The toner and the carrier were mixed so that the toner density would be 7 wt %.

The results are compiled in Table 13. The surface roughness of both the photoconductor and the blade at the initial stage was observed normal, but the surface roughness increased as more sheets were copied, and the surface roughness largely exceeded the normal value. Therefore, the values of conditions to cause cleaning failure of spherical toner were increased, and thus, the large amount of cleaning failure occurred.

TABLE 13

| EXAMPLE | 10-POINT AVERAGE ROUGHNESS OF PHOTO-CONDUCTOR Rz JIS (μm) INITIAL STAGE | AFTER RUN | FRICTIONAL RESISTANCE Rf (gf) AFTER 200 SHEETS | AFTER RUN | BLADE EDGE SURFACE ROUGHNESS/ MAXIMUM DEPTH OF CHIPPED PART(μm) INITIAL STAGE | AFTER RUN | CLEANING CAPABILITY | RESOLUTION LONGITUDI-NAL/LATERAL (LINE/mm) | DETERMINATION |
|---|---|---|---|---|---|---|---|---|---|
| COMPARATIVE EX. 10 | 0.485 | 0.76 | 175 | 183 | 68 | 98 | FAILURE | 6.3/7.1 | XX |
| COMPARATIVE EX. 11 | 0.98 | 2.38 | 192 | 224 | 48 | 128 | FAILURE | 8.0/6.3 | XX |
| COMPARATIVE EX. 12 | 0.688 | 3.12 | 163 | 245 | 39 | 145 | FAILURE | 6.3/5.6 | XX |

Examples 22 to 23

As an image forming apparatus for evaluation, Ipsio Color 8000 machine (including the cleaning blade and cleaning brush, produced by Ricoh Co., Ltd.) was prepared. As photoconductors for evaluation, the type A organic photoconductor and the type B organic photoconductor were prepared. More specifically, the type A organic photoconductor as sample No. 1 (Example 22) had 10-point average roughness RzJIS of 0.151 μm, and the type B organic photoconductors as sample No. 4 (Example 23) had 10-point average roughness RzJIS of 0.463 μm. The charging member was provided for non-contact charging, and when it was grounded, the space with the photoconductor was about 58 μm.

The type A organic photoconductor was set in a magenta station (Example 22) and the type B organic photoconductor was set in a cyan station (Example 23).

In order to prevent locking at initial rotation of the photoconductor, powder of PTFE (Lubron L-2 produced by Daikin Industries, Ltd.) was thinly evenly applied to the photoconductor in advance with non-woven fabric (Haize Gauge, produced by Asahi Chemical Industry Co., Ltd.) to reduce frictional resistance to about 50 gf, and was also applied to the blade edge.

Developer for developing an electrostatic latent image obtained by mixing toner with carrier in the following manner was used. The toner was obtained by adding 0.02% of zinc stearate (SZ2000, produced by Sakai Chemical Industry Co., Ltd.), which reduces frictional resistance of the photoconductor, to spherical toner (produced by Ricoh Co., Ltd.) obtained using the emulsion polymerization method to have a weight average particle size of about 5.2 μm and an average sphericity of 0.991. The carrier (produced by Ricoh Co., Ltd.) was coated with silicone resin to have weight average particle size of about 52 μm. The toner and the carrier were mixed so that the toner density would be 5 wt %.

A member obtained in the following manner was used for the cleaning blade. The member was obtained by fixing a polyurethane blade including a blade edge, which has 10-point average roughness RzJIS of 10 μm or less and JIS-A hardness of 77 degrees, to a support base so as to have a free length of 7 mm. A contact pressure was set to 20 grams.

A cleaning brush obtained by using the acrylic fiber SA-7 (Toray Industries, Inc.) was used, and the cleaning brush was grounded.

The method of evaluation was executed by applying a voltage with an ac voltage of 1200 volts/980 hertz superposed on a dc voltage of −780 volts to the charging member, setting a set value of a charging potential Vd of the photoconductor after checking it 10 cycles to about −600 volts (charging potential before formation of electrostatic latent images), and adjusting output of an LD device for image exposure so that the potential VI of an image portion after the image exposure was −100 volts. Furthermore, the potential of developing bias was set to −500 volts. The images were evaluated by inputting signals of images including character images and lines from a personal computer. The number of sheets for evaluation was 50,000 sheets.

The results are compiled in Table 14. By using the cleaning brush, even if the toner having almost perfect sphericity was used, cleaning was performed at a level at which no particular problem occurred in practical use. It is noted that in the photoconductor with the filler added, the blade edge was largely chipped, so spotted trace of cleaning failure was slightly observed with the toner having average sphericity of 0.991. However, the cleaning failure occurred unevenly, and therefore, the cleaning capability after 50,000 sheets still remain within the practical limits.

TABLE 14

| | 10-POINT AVERAGE ROUGHNESS OF PHOTO-CONDUCTOR Rz JIS (μm) | | FRICTIONAL RESISTANCE Rf (gf) | | BLADE EDGE SURFACE ROUGHNESS/ MAXIMUM DEPTH OF CHIPPED PART(μm) | | 1dot | | |
|---|---|---|---|---|---|---|---|---|---|
| EXAMPLE | INITIAL STAGE | AFTER RUN | AFTER 200 SHEETS | AFTER RUN | INITIAL STAGE | AFTER RUN | CLEANING CAPABILITY | REPRO-DUCIBILITY | DETER-MINATION |
| EXAMPLE 22 | 0.151 | 0.312 | 125 | 171 | 10> | 52 | VERY GOOD | VERY GOOD | ○ |
| EXAMPLE 23 | 0.463 | 0.623 | 131 | 152 | 10> | 69 | GOOD | VERY GOOD | Δ |

As explained above, in order to improve cleaning capability of residual powder and maintain the cleaning capability, the followings are important. The frictional resistance between the photoconductor and the cleaning blade is reduced to a value as small as possible, and the edge of the cleaning blade is prevented from curling. Further, the surface roughness of the 10-point average roughness or the maximum height of the surface layer of the photoconductor is prevented from making the height higher than a toner particle size or a size larger than a fine particle size. Furthermore, the edge of the cleaning blade is prevented from being chipped by some parts of the photoconductor or any hard foreign matters so that toner may pass through the chipped part (toner escaping). If the frictional resistance can be suppressed to a minimum, the curling of the cleaning blade can be suppressed. Therefore, it is possible to suppress the toner escaping even if the surface roughness is larger than toner size.

According to one aspect of the present invention, the surface roughness (10-point average roughness) of the photoconductor, frictional resistance, and the surface roughness of the edge of the cleaning blade are specified to optimal values. It is thereby possible to perform efficient cleaning on irregular toner such as toner including many small-sized toner particles produced in the pulverization method and spherical toner having high average sphericity, and to prevent occurrence of background stains on copied sheets.

In order to perform sufficiently cleaning on almost spherical polymer toner having high average sphericity, it is important to keep the photoconductor and the cleaning blade in tight contact with each other and maintain a condition such that a space is not formed. Therefore, the photoconductor is required to have a surface roughness so that the blade edge is hard to be distorted when the cleaning blade is used and toner escaping does not occur. Furthermore, the photoconductor should have a frictional resistance being so low that it is prevented to partially distort the cleaning blade, to cause the stick-slip phenomenon to occur, and to vibrate the photoconductor, when residual powder such as toner on the photoconductor is cleaned off.

On the other hand, the cleaning blade has a hardness and a contact pressure being so soft that it is prevented to cause damage to the photoconductor. When the photoconductor is used, the cleaning blade should include an edge having a surface roughness being so low that toner escaping is prevented. Particularly, if highly spherical toner is smaller or its sphericity is closer to perfect sphericity (sphericity=1.0), the spherical toner tends to slide into a small space between the cleaning blade and the photoconductor. Therefore, it is not allowed to form even a micro space.

In order to reduce the load of the cleaning blade and the damage thereto, the amount of toner rushing to the edge of the cleaning blade is desirably as small as possible. Therefore, it is important to eliminate distortion of the edge by suppressing the frictional resistance to low.

Furthermore, by specifying the surface roughness (10-point average roughness) of the photoconductor, frictional resistance, and the surface roughness of the edge of the cleaning blade to optimal values, it is possible to maintain good cleaning capability even if the spherical toner has high average sphericity, thus providing high definition images over a long period.

Moreover, the frictional resistance varies depending on a measuring environment, and therefore, by specifying the measuring environment to appropriate ones, it is possible to specify the range of the frictional resistance to appropriate values.

As for the surface roughness of the edge of the cleaning blade, lower is better because a tight contact between the edge and the photoconductor is desirable. However, the surface roughness is too low, the cleaning blade cannot move smoothly because the contact is so tight caused by high frictional resistance between the two.

Furthermore, by specifying the lower limit of the surface roughness of the edge to 10 μm, it is possible to maintain the cleaning capability within the practical range and to prevent toner escaping.

Moreover, if the hardness of the cleaning blade is higher, the frictional resistance and the resistance against foreign matters on the photoconductor are higher, and the stick-slip phenomenon is therefore harder to occur. However, if the hardness is too high, the photoconductor may be scratched, and therefore, the upper limit is desirably 90 degrees or lower. If the hardness is too low, the stick-slip phenomenon may easily occur though it depends on surface resistivity of the photoconductor, and the cleaning blade is susceptible to distortion due to scratches on the photoconductor. Therefore, the lower limit is desirably 70 degrees or higher.

By specifying the hardness to such a range, it is possible to achieve the tight contact between the photoconductor and the cleaning blade, and to maintain stable cleaning capability over a long period.

Furthermore, if the contact pressure of the cleaning blade is higher, the photoconductor is more susceptible to damage, which causes degradation of the edge of the cleaning blade, resulting in cleaning failure. By setting the contact pressure to an appropriate value, desirable cleaning can be performed. If the contact pressure becomes lighter than 10 g/cm, a space between the photoconductor and the cleaning blade is easily formed with even small force, which causes cleaning failure to more easily occur.

On the other hand, if the contact pressure becomes heavier than 40 g/cm, then the photoconductor is easily damaged, the distortion of the edge and the stick-slip phenomenon may easily occur, and toner escaping from spaces may occur. In order to lessen scratches on the photoconductor and maintain the cleaning capability, it is desirable that the contact pressure is lower, preferably from 10 g/cm to 25 g/cm. Therefore, even if highly spherical toner is used, it is possible to maintain satisfactory cleaning capability while the photoconductor is prevented from being scratched.

Moreover, the cleaning blade made of polyurethane rubber is used to easily realize appropriate hardness and contact pressure.

Furthermore, the maximum valley depth Rv of the edge of the cleaning blade is controlled so as not to exceed 40 μm, it is thereby possible to maintain satisfactory cleaning capability of residual powder.

Moreover, by further controlling the maximum valley depth Rv of the edge so as not to exceed 30 μm, it is possible to increase an allowable margin for cleaning capability of residual powder and maintain satisfactory cleaning capability even if the frictional resistance increases.

Furthermore, almost all photoconductors except for the photoconductor having the lubricant-added layer has frictional resistance on its surface of generally 250 gf or 350 gf or high. Even if such a photoconductor is set in an image forming apparatus and image formation is to be performed, the photoconductor does not rotate, or even if rotating, the cleaning blade is reversed, which causes the photoconductor to be largely damaged, image quality to be degraded, and cleaning failure to occur.

Therefore, it is important to apply a lubricant to the photoconductor and the cleaning blade for image formation. By applying the lubricant to the edge of the cleaning blade, scratches are not formed, and it is thereby possible to prevent cleaning failure to occur at an initial stage and to maintain good image quality.

Moreover, even if toner having average sphericity ranging from 0.96 to 0.998 that is close to perfect sphericity is used, good cleaning capability is maintained. Therefore, it is possible to provide high definition images with sharpness, uniformity, and good contrast, and to obtain advantages such that residual toner is reduced because of good transfer capability and durability of the cleaning blade is extended because of lighter load on the cleaning blade.

Furthermore, by providing the cleaning brush, the amount of toner to be conveyed to the cleaning blade is reduced to cause the load of the cleaning blade to be reduced. Therefore, even if the spherical toner close to perfect sphericity is hard to be cleaned off by using the cleaning blade singly, cleaning is satisfactorily performed.

By providing the cleaning brush, deposition of foreign matters on the photoconductor is suppressed, and increase in frictional resistance in association with the deposition of foreign matters is suppressed. By using a cleaning brush made of looped fibers, scratches are hardly made on the photoconductor, and the cleaning brush is excellent in cleaning capability, and has conductivity. Therefore, even if the cleaning brush is charged, it is easily discharged, and charges of toner adhered to the cleaning brush are discharged.

Moreover, because toner is easily separated from the cleaning brush and the photoconductor, it is possible to prevent re-deposition of toner on the photoconductor and to reduce the amount of toner to rush to the cleaning blade. Therefore, it is possible to perform satisfactory cleaning on even almost spherical toner.

Furthermore, almost all photoconductors except for the photoconductor having the lubricant-added layer has frictional resistance on its surface of generally 250 gf or 350 gf or high. However, by providing the frictional-resistance reducing unit that reduces frictional resistance of the photoconductor, the frictional resistance can easily be set to a required range of 45 gf<Rf<200 gf.

Moreover, the frictional-resistance reducing unit includes the lubricant applying unit that applies a lubricant to the surface layer of the photoconductor. It is thereby possible to easily realize the frictional resistance of 45 gf<Rf<200 gf.

Furthermore, when a lubricant layer is continuously formed on the surface layer of the photoconductor, the frictional resistance may become too low, and the corona product materials produced during charging is hardly scraped off, which causes the surface resistivity on the surface of the photoconductor to increasingly lower and image quality to be degraded. Therefore, when the lubricant is applied to the photoconductor, uneven application is more effective in occurrence of abnormal phenomenon such as image flow, than even application of the lubricant.

Moreover, by using zinc stearate or fluororesin as the lubricant, the image quality and durability of the surface layer of the photoconductor are not affected by the lubricant.

Furthermore, the surface of the organic photoconductor is easily scraped by sliding of the cleaning blade or developer, and the charging member that produces contaminants such as ozone and NOx is used for charging. The contaminants are deposited on the surface of the photoconductor, but the deposition causes degradation of image quality. Therefore, the surface is required to be worn by a certain amount. By providing the organic photoconductor for the charge transport layer, it is possible to maintain high image quality.

Moreover, by forming the filler-containing charge transport layer as a photoconductive layer on the surface layer of the photoconductor, durability of the photoconductor is achieved without reduction of photosensitivity of the photoconductor. Thus, it is possible to achieve stability of image quality while maintaining good cleaning capability.

Furthermore, the adequate composition of the filler-containing charge transport layer is revealed.

Moreover, by specifying the condition of charging by the charger, stable charging characteristic and an electrostatic latent image necessary and sufficient for image formation are formed. Therefore, it is possible to provide image quality with good cleaning capability and a good SN ratio over a long period.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus that forms an image using an electrophotographic process, comprising:

a photoconductor that includes at least a conductive support, an undercoat layer, and a photoconductive layer, wherein the photoconductor has a surface with either a 10-point average roughness RzJIS of 0.1 μm≦RzJIS≦1.5 μm or a maximum height Rz of 2.5 μm or lower;

a charger that charges the photoconductor;

a developing device that develops a latent image on the photoconductor with toner to obtain a toner image;

a transfer device that transfers the toner image to a transfer element;

a cleaning device including a cleaning blade that cleans off toner remaining on the photoconductor after the toner image has been transferred;

the photoconductor having a frictional resistance Rf of from 45 gram-force to 200 gram-force against a flat type belt made of polyurethane, and the belt having a JIS-A hardness of 83 degrees, a width of 5 mm, a length of 325 mm, a thickness of 2 mm, and a dead weight of 4.58 grams, the frictional resistance Rf of from 45 gram-force to 200 gram-force existing when the belt is suspended in a circumferential direction of the photoconductor;

a 100-gram load is hung at one end of the belt so that a contact length thereof with the photoconductor is 3 mm and a contact area is 15 $mm^2$ during determination of frictional resistance of the photoconductor against the belt, a digital force gauge is fixed to another end of the belt and a value is read from the digital force gauge when the belt moves, and the frictional resistance Rf measured under such conditions that a value obtained by subtracting the 100-gram load from the read value of the digital force gauge is determined as the frictional resistance Rf.

2. The image forming apparatus according to claim 1, wherein the photoconductor has a 10-point average roughness RzJIS of 0.1 μm≦RzJIS≦1.0 μm, the belt has a JIS-A hardness of 83 degrees, and the cleaning blade is in contact with the photoconductor in a counter direction and includes an edge having a surface roughness of 70 μm or lower.

3. The image forming apparatus according to claim 1, wherein the frictional resistance Rf measured at a temperature ranging from 15° C. to 22° C. and a humidity ranging from 55% RH to 65% RH.

4. The image forming apparatus according to claim 1, wherein a surface roughness of an edge of the cleaning blade ranges from 10 μm to 70 μm.

5. The image forming apparatus according to claim 1, wherein the JIS-A hardness of an edge of the cleaning blade that comes in contact with the photoconductor ranges from 70 degrees to 90 degrees.

6. The image forming apparatus according to claim 1, wherein the cleaning blade comes in contact with the photoconductor in a counter direction at a contact pressure ranging from 10 g/cm to 40 g/cm.

7. The image forming apparatus according to claim 1, wherein the cleaning blade comes in contact with the photoconductor in a counter direction at a contact pressure ranging from 10 g/cm to 25 g/cm.

8. The image forming apparatus according to claim 1, wherein the cleaning blade is made of polyurethane rubber.

9. The image forming apparatus according to claim 1, wherein a maximum valley depth Rv of an edge of the cleaning blade in contact with the photoconductor is 40 μm or less.

10. The image forming apparatus according to claim 1, wherein a maximum valley depth Rv of an edge of the cleaning blade in contact with the photoconductor is 30 μm or less.

11. The image forming apparatus according to claim 1, wherein a lubricant is applied to an edge of the cleaning blade in contact with the photoconductor.

12. The image forming apparatus according to claim 1, wherein the toner has an average sphericity ranging from 0.96 to 0.998.

13. The image forming apparatus according to claim 1, wherein the cleaning device includes a cleaning brush provided on an upstream side of the cleaning blade in a direction of rotation of the photoconductor, the cleaning brush being made of conductive looped fiber.

14. The image forming apparatus according to claim 13, wherein the cleaning brush is connected to either of a power supply that supplies a voltage to the cleaning brush or an electric circuit that grounds the cleaning brush.

15. The image forming apparatus according to claim 1, further comprising:

a frictional-resistance reducing unit that reduces frictional resistance of the photoconductor so as to maintain the frictional resistance Rf in the range of 45 gram-force<Rf<200 gram-force.

16. The image forming apparatus according to claim 15, wherein the frictional-resistance reducing unit includes a lubricant applying unit that applies a lubricant to a surface layer of the photoconductor.

17. The image forming apparatus according to claim 16, wherein the lubricant applying unit non-uniformly applies the lubricant over a surface layer of the photoconductor.

18. The image forming apparatus according to claim 16, wherein the lubricant is either of zinc stearate or fluororesin.

19. The image forming apparatus according to claim 1, wherein a charge transport layer of the photoconductor is an organic photoconductive layer.

20. The image forming apparatus according to claim 1, wherein a charge transport layer of the photoconductor includes two layers, a charge transport layer without filler and a filler-containing charge transport layer with filler.

21. The image forming apparatus according to claim 20, wherein a weight average particle size of the filler, which forms the filler-containing charge transport layer, ranges from 0.2 μm to 0.7 μm, and a content of the filler ranges from 10% by weight to 30% by weight of the total weight of the filler-containing charge transport layer.

22. The image forming apparatus according to claim 1, wherein the charger includes a charging member that is applied with either of a direct current voltage or a direct current voltage with an alternating current voltage superposed thereon, and sets a charging potential of the photoconductor before formation of an electrostatic latent image to from 400 volts to 800 volts to form an image.

23. A process cartridge comprising a cartridge case that is detachably mounted in an image forming apparatus accommodates at least a photoconductor and a cleaning device of an image forming apparatus, wherein the image forming apparatus forms an image using an electrophotographic process and includes a photoconductor that includes at least a conductive support, an undercoat layer, and a photoconductive layer, wherein the photoconductor has a surface with either a 10-point average roughness RzJIS of 0.1 μm≦RzJIS≦1.5 μm or a maximum height Rz of 2.5 μm or lower;

a charger that charges the photoconductor;

a developing device that develops a latent image on the photoconductor with toner to obtain a toner image;

a transfer device that transfers the toner image to a transfer element;

a cleaning device including a cleaning blade that cleans off toner remaining on the photoconductor after the toner image has been transferred;

the photoconductor having a frictional resistance Rf of from 45 gram-force to 200 gram-force against a flat type belt made of polyurethane, and the belt having a JIS-A hardness of 83 degrees, a width of 5 mm, a length of 325 mm, a thickness of 2 mm, and a dead weight of 4.58 grams, the frictional resistance Rf of from 45 gram-force to 200 gram-force existing when the belt is suspended in a circumferential direction of the photoconductor;

a 100-gram load is hung at one end of the belt so that a contact length thereof with the photoconductor is 3 mm and a contact area is 15 $mm^2$ during determination of frictional resistance of the photoconductor against the belt, a digital force gauge is fixed to another end of the belt and a value is read from the digital force gauge when the belt moves, and the frictional resistance Rf measured under such conditions that a value obtained by subtracting the 100-gram load from the read value of the digital force gauge is determined as the frictional resistance Rf.

24. The process cartridge according to claim 23, wherein the photoconductor has a 10-point average roughness RzJIS of 0.1 μm≦RzJIS≦1.0 μm, the belt has a JIS-A hardness of 83 degrees, and the cleaning blade is in contact with the photoconductor in a counter direction and includes an edge having a surface roughness of 70 μm or lower.

25. The process cartridge according to claim 23, wherein the frictional resistance Rf is measured at a temperature ranging from 15° C. to 22° C. and a humidity ranging from 55% RH to 65% RH.

26. The process cartridge according to claim 23, wherein a surface roughness of an edge of the cleaning blade ranges from 10 μm to 70 μm.

27. The process cartridge according to claim 23, wherein the JIS-A hardness of an edge of the cleaning blade that comes in contact with the photoconductor ranges from 70 degrees to 90 degrees.

28. The process cartridge according to claim 23, wherein the cleaning blade comes in contact with the photoconductor in a counter direction at a contact pressure ranging from 10 g/cm to 40 g/cm.

29. The process cartridge according to claim 23, wherein the cleaning blade comes in contact with the photoconductor in a counter direction at a contact pressure ranging from 10 g/cm to 25 g/cm.

30. The process cartridge according to claim 23, wherein the cleaning blade is made of polyurethane rubber.

31. The process cartridge according to claim 23, wherein a lubricant is applied to an edge of the cleaning blade.

32. The process cartridge according to claim 23, wherein the cleaning device includes a cleaning brush provided on an upstream side of the cleaning blade in a direction of rotation of the photoconductor, the cleaning brush being made of conductive looped fiber.

33. The process cartridge according to claim 23, further comprising:

a frictional-resistance reducing unit that reduces frictional resistance of the photoconductor so as to maintain the frictional resistance Rf in the range of 45 gram-force<Rf<200 gram-force.

34. The process cartridge according to claim 33, wherein the frictional-resistance reducing unit includes a lubricant applying unit that applies a lubricant to a surface layer of the photoconductor.

35. The process cartridge according to claim 34, wherein the lubricant applying unit non-uniformly applies the lubricant over a surface layer of the photoconductor.

36. The process cartridge according to claim 34, wherein the lubricant is either of zinc stearate or fluororesin.

37. The process cartridge according to claim 23, wherein a charge transport layer of the photoconductor is an organic photoconductive layer.

38. The process cartridge according to claim 23, wherein a charge transport layer of the photoconductor includes two layers, a charge transport layer without filler and a filler-containing charge transport layer with filler.

39. The process cartridge according to claim 38, wherein a weight average particle size of the filler, which forms the filler-containing charge transport layer, ranges from 0.2 μm to 0.7 μm, and a content of the filler ranges from 10% by weight to 30% by weight of the total weight of the filler-containing charge transport layer.

40. A method of forming an image with an image forming apparatus, the image forming apparatus configured to form an image using an electrophotographic process and a including a photoconductor that includes at least a conductive support, an undercoat layer, and a photoconductive layer, the photoconductor having a surface with either a 10-point average roughness RzJIS of 0.1 μm≦RzJIS≦1.5 μm or a maximum height Rz of 2.5 μm or lower, a charger that charges the photoconductor, a developing device that develops a latent image on the photoconductor with toner to obtain a toner image, a transfer device that transfers the toner image to a transfer element, a cleaning device including a cleaning blade that cleans off toner remaining on the photoconductor after the toner image has been transferred, the photoconductor having a frictional resistance Rf of from 45 gram-force to 200 gram-force against a flat type belt made of polyurethane, and the belt having a JIS-A hardness of 83 degrees, a width of 5 mm, a length of 325 mm, a thiekness of 2 mm, and a dead weight of 4.58 grams, the method comprising: the frietional resistance Rf of from 45 gram-force to 200 gram-force existing when the belt is suspended in a circumferential direction of the photoconductor;

a 100-gram load is hung at one end of the belt so that a contact length thereof with the photoconductor is 3 mm and a contact area is 15 $mm^2$;

a force gauge is connected to another end of the belt;

a value is read from the force gauge when the belt moves, and the frictional resistance RF measured under such conditions that a value obtained by subtracting the 100-gram load from the read value of the force gauge is determined as the frictional resistance Rf, the method, comprising:

forming the image with the image forming apparatus in which the frictional resistance Rf ofthe photoconductor against the belt is 45 gram-force<Rf<200 gram-force.

* * * * *